US010759182B2

(12) United States Patent
Yamada et al.

(10) Patent No.: US 10,759,182 B2
(45) Date of Patent: Sep. 1, 2020

(54) LIQUID EJECTION APPARATUS AND LIQUID EJECTION HEAD

(71) Applicant: CANON KABUSHIKI KAISHA, Tokyo (JP)

(72) Inventors: Kazuhiro Yamada, Yokohama (JP); Yohei Nakamura, Yokohama (JP); Yoshiyuki Nakagawa, Kawasaki (JP); Naozumi Nabeshima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/139,972

(22) Filed: Sep. 24, 2018

(65) Prior Publication Data

US 2019/0100024 A1 Apr. 4, 2019

(30) Foreign Application Priority Data

Sep. 29, 2017 (JP) ..... 2017-191327
Aug. 28, 2018 (JP) ..... 2018-159187

(51) Int. Cl.
*B41J 2/175* (2006.01)
*B41J 2/18* (2006.01)
(Continued)

(52) U.S. Cl.
CPC ..... *B41J 2/18* (2013.01); *B41J 2/1404* (2013.01); *B41J 2/14024* (2013.01);
(Continued)

(58) Field of Classification Search
CPC ..... B41J 2/18; B41J 2/14024; B41J 2/1404; B41J 2/175; B41J 2/14145; B41J 2/1433;
(Continued)

(56) References Cited

U.S. PATENT DOCUMENTS 9,278,540 B2 3/2016 Seki et al. ..... B41J 2/17513
9,315,041 B2 4/2016 Moriguchi et al. ..... B41J 2/17596
(Continued)

FOREIGN PATENT DOCUMENTS

| | | |
|---|---|---|
| EP | 1946849 | 7/2008 |
| EP | 2628597 | 8/2013 |
| WO | 2017/000997 | 1/2017 |

OTHER PUBLICATIONS

Extended European Search Report dated Feb. 22, 2019 in counterpart European Application No. 18196534.4.
U.S. Appl. No. 16/139,999, filed Sep. 24, 2018.

*Primary Examiner* — Yaovi M Ameh
(74) *Attorney, Agent, or Firm* — Venable LLP

(57) ABSTRACT

A liquid ejection apparatus includes an ejection port ejecting a liquid, a pressure chamber storing the liquid, an element generating energy for ejecting the liquid in the pressure chamber, first and second tanks which can store the liquid, a flow passage establishing communication between the first and second tanks through the pressure chamber, a switching unit switching a flowing direction of the liquid in the flow passage between a first direction from the first tank to the second tank and a second direction being opposite to the first direction, and a pressure compensation unit. When a pressure in a downstream side flow passage portion downstream of the pressure chamber has a predetermined pressure or below, the pressure compensation unit compensates for reduction in pressure in the downstream side flow passage portion by supplying the liquid to the downstream side flow passage portion.

24 Claims, 22 Drawing Sheets

(51) Int. Cl.
*B41J 2/165* (2006.01)
*B41J 2/14* (2006.01)

(52) U.S. Cl.
CPC ..... *B41J 2/1433* (2013.01); *B41J 2/14145* (2013.01); *B41J 2/165* (2013.01); *B41J 2/175* (2013.01); *B41J 2/17596* (2013.01); *B41J 2202/12* (2013.01); *B41J 2202/20* (2013.01); *B41J 2202/21* (2013.01)

(58) Field of Classification Search
CPC .... B41J 2/165; B41J 2/17596; B41J 2202/21; B41J 2202/20; B41J 2202/12
See application file for complete search history.

(56) References Cited

U.S. PATENT DOCUMENTS 9,327,513 B2 5/2016 Moriguchi et al. ..... B41J 2/175
9,333,758 B2 5/2016 Koshikawa et al. ..... B41J 2/17523
9,358,803 B2 6/2016 Moriguchi et al. ..... B05B 7/24
9,375,938 B2 6/2016 Kondo et al. ..... B41J 2/1752
9,597,884 B2 3/2017 Nanjo et al. ..... B41J 2/17526
9,597,888 B2 3/2017 Takahashi et al. .. B41J 2/17566
9,694,585 B2 7/2017 Shiba et al. ..... B41J 2/17506
9,751,317 B2 9/2017 Nakamura et al. .. B41J 2/17506
9,821,562 B2 11/2017 Nanjo et al. ..... B41J 2/17526
9,840,082 B2 12/2017 Nanjo et al. ..... B41J 2/17526
9,908,338 B2 3/2018 Koshikawa et al. ..... B41J 2/17559
9,914,308 B2 3/2018 Yamada et al. ..... B41J 2/18
9,925,791 B2 3/2018 Yamada ..... B41J 2/17563
9,975,340 B2 5/2018 Karita et al. ..... B41J 2/14112
9,981,464 B2 5/2018 Karita et al. ..... B41J 2/1404
10,005,287 B2 6/2018 Yamada et al. ..... B41J 2/17596
2010/0245495 A1* 9/2010 Katada ..... B41J 2/175 347/85
2012/0200619 A1 8/2012 Bibl ..... 347/6
2014/0333694 A1* 11/2014 Martin ..... B41J 2/14153 347/19
2015/0251430 A1 9/2015 Ishii et al. ..... 347/30
2017/0087867 A1 3/2017 Sato et al. ..... B41J 2/17596
2017/0197413 A1 7/2017 Nakagawa et al. ..... B41J 2/14145
2017/0197426 A1 7/2017 Nagai et al. ..... B41J 2/14024
2017/0341404 A1 11/2017 Nakagawa ..... B41J 2/17553
2017/0341406 A1 11/2017 Yamada et al. ..... B41J 2/17596
2018/0015728 A1 1/2018 Nanjo et al. ..... B41J 2/17526
2018/0154647 A1 6/2018 Coma Vives et al. ..... B41J 2/17566
2018/0244039 A1 8/2018 Karita et al. ..... B41J 2/1404

* cited by examiner

LIQUID EJECTION APPARATUS AND LIQUID EJECTION HEAD

BACKGROUND OF THE INVENTION

Field of the Invention

The present invention relates to a liquid ejection apparatus which circulates a liquid in a liquid ejection head and performs ejection of the liquid, and to the liquid ejection head.

Description of the Related Art

In recent years, there has been proposed a configuration applicable to a printing apparatus (a liquid ejection apparatus) using a printing head (a liquid ejection head) capable of ejecting an ink (a liquid) from an ejection port, in which a thickened ink, bubbles, and contaminants are removed by generating a flow of the ink that passes through the ejection port.

Meanwhile, International Publication No. WO2017/000997 describes a configuration that enables inversion of a direction to supply an ink to a printing head. Specifically, there is disclosed a configuration which includes a switching mechanism formed from a pump and multiple driving valves and provided between the printing head and two ink tanks, and is capable of bilaterally switching between two flow directions of the ink from one of the ink tanks to the other ink tank through the printing head and vice versa. The flow of the ink is generated by an operation of the pump, and the flow direction is inverted by switching the valves. By inverting the ink flow direction, the ink is agitated in the ink tanks and in flow passages, whereby the flow passages are prevented from clogging due to sedimentation and deposition of solid components therein.

In a printing apparatus of International Publication No. WO2017/000997, the printing head is refilled (replenished) with the ink through a flow passage located on an upstream side of the printing head in the ink flow direction. In the meantime, the printing head is prevented from being refilled with the ink that flows back through a flow passage on a downstream side by using the pump located on the downstream side of the printing head in the ink flow direction. For this reason, when printing is performed under a printing condition to eject a large amount of the ink in a short time such as high duty printing, the printing head may be refilled insufficiently with only the ink from the flow passage on the upstream side, whereby a pressure in the printing head is prone to a significant change in part. To be more precise, regarding an ejection port which repeats ink ejecting operations among multiple ejection ports, a negative pressure on a downstream side of the ejection port is increased. This negative pressure leads to an increase in flow volume of the ink that passes near other ejection ports in the state of not ejecting the ink. Hence, the negative pressure may be significantly increased at the latter ejection ports and its proper ejection may be complicated, thus leading to deterioration in quality of a printed image. The above-described deterioration in quality of the printed image becomes more prominent as the number of ejection ports provided to the printing head is larger or as the number of the ejection ports in the state of not ejecting the ink is larger in high duty printing.

SUMMARY OF THE INVENTION

The present invention provides a liquid ejection head used in such a way as to circulate a liquid in the inside even when printing is not performed. Here, a state of ejection of the liquid from the liquid ejection head is stabilized by improving a refilling performance of the liquid ejection head with the liquid while maintaining a function to circulate the liquid.

In the first aspect of the present invention, there is provided a liquid ejection apparatus comprising:

an ejection port configured to eject a liquid;

a pressure chamber configured to store the liquid to be ejected from the ejection port;

an element configured to generate energy for ejecting the liquid in the pressure chamber;

a first tank and a second tank each configured to be capable of storing the liquid;

a flow passage configured to establish communication between the first tank and the second tank through the pressure chamber;

a switching unit configured to switch a flowing direction of the liquid in the flow passage between a first direction to flow from the first tank to the second tank and a second direction to flow from the second tank to the first tank; and a pressure compensation unit configured, when a pressure in a downstream side flow passage portion of the flow passage located on a downstream side of the pressure chamber in the flowing direction of the liquid is a predetermined pressure or below, to compensate for reduction in pressure in the downstream side flow passage portion by supplying the liquid to the downstream side flow passage portion.

In the second aspect of the present invention, there is provided a liquid ejection head to be used by being mounted on the liquid ejection apparatus according to the first aspect of the present invention, comprising:

an element board including the ejection port configured to eject the liquid, the pressure chamber configured to store the liquid to be ejected from the ejection port, and the element configured to generate the energy for ejecting the liquid in the pressure chamber, the first tank and the second tank each configured to be capable of storing the liquid; and a support body configured to support the element board, and provided with the flow passage to establish the communication between the first tank and the second tank through the pressure chamber.

In the third aspect of the present invention, there is provided a liquid ejection apparatus comprising:

an ejection port configured to eject a liquid;

a pressure chamber configured to store the liquid to be ejected from the ejection port;

an element configured to generate energy for ejecting the liquid in the pressure chamber;

a first tank and a second tank each configured to be capable of storing the liquid;

a flow passage configured to establish communication between the first tank and the second tank through the pressure chamber;

a switching unit configured to switch a flowing direction of the liquid in the flow passage between a first direction to flow from the first tank to the second tank and a second direction to flow from the second tank to the first tank;

a first pressure adjustment passage and a second pressure adjustment passage each configured to adjust a pressure in the first tank and the second tank;

a communication passage configured to establish communication between the first pressure adjustment passage and the second pressure adjustment passage; and a passive valve provided in the communication passage, and configured to open and close the communication passage depending on a difference between the pressure in a downstream side flow passage portion located on a downstream side of the pressure chamber in the flowing direction of the liquid and a pressure in an upstream side flow passage portion located on an upstream side of the pressure chamber in the flowing direction of the liquid.

According to the present invention, pressure control is conducted by refilling a liquid ejection head with a liquid as appropriate depending on a pressure condition in the liquid ejection head. Thus, it is possible to improve a refilling performance of the liquid ejection head with the liquid and to stabilize a state of ejection of the liquid ejection head.

Moreover, according to the present invention, the pressure control necessary for multiple flow passages can be performed by using a certain configuration in common. Thus, it is possible to provide the liquid ejection apparatus that can perform an ejecting operation stably with a small number of components, at low costs, and in a small size.

Further features of the present invention will become apparent from the following description of exemplary embodiments with reference to the attached drawings.

DESCRIPTION OF THE EMBODIMENTS

Preferred embodiments of a liquid ejection apparatus of the present invention will be described below with reference to the drawings. It is to be noted, however, that the scope of the present invention shall be defined by the appended claims and the following descriptions does not intend to limit the scope of the present invention. It is to be also understood that the shapes, layouts, and other features described below do not intend to limit the scope of this invention.

First Embodiment (Inkjet Printing Apparatus)

Figure 1A:
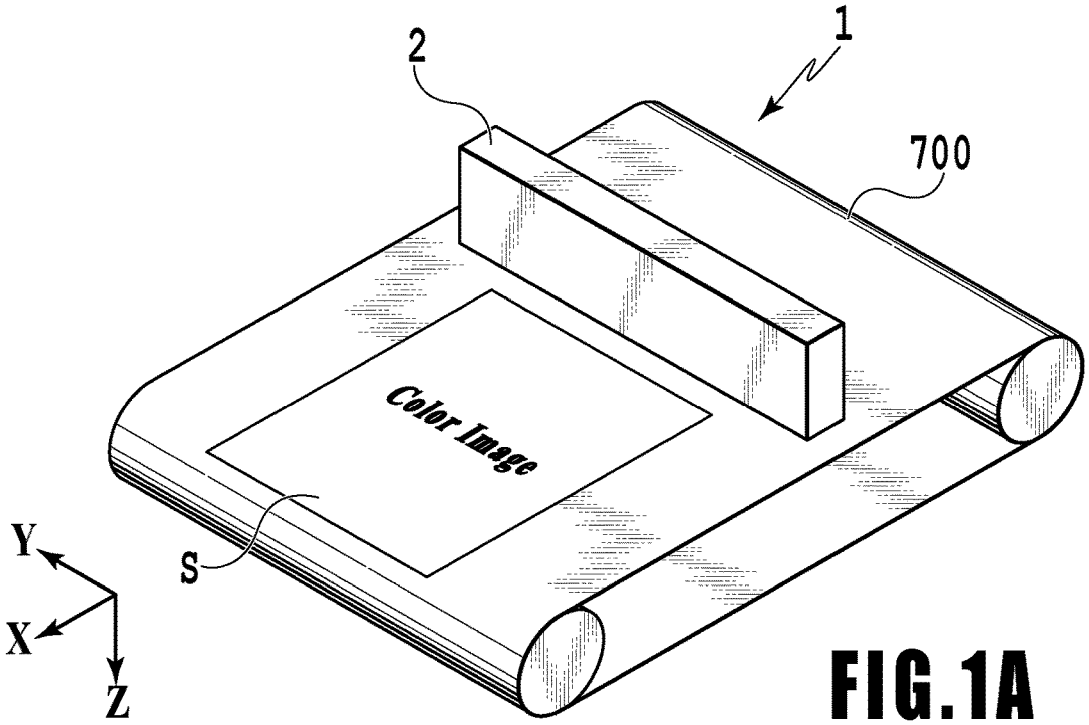
FIG. 1A is a schematic configuration diagram of a printing apparatus according to a first embodiment of the present invention.
Figure 1B:
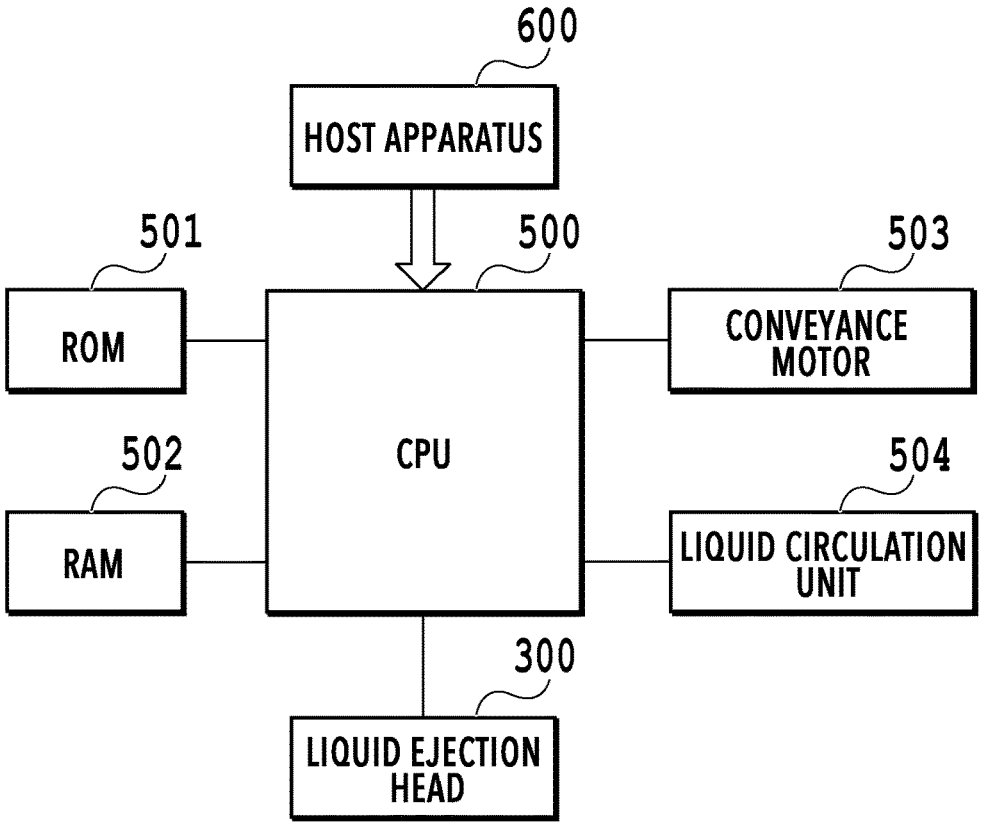
FIG. 1B is a block diagram of a control system in the printing apparatus of FIG. 1A.

FIG. 1A is a schematic configuration diagram and FIG. 1B is a control block diagram of an inkjet printing apparatus (hereinafter simply referred to as a printing apparatus or an apparatus) that can be used as a liquid ejection apparatus of the present invention. As shown in FIG. 1A, a sheet S as a printing medium is conveyed in an X direction at a predetermined speed by a conveyance unit 700 in such a way as to be passed below a printing unit 2. The printing unit 2 mainly includes a liquid ejection head 300 and a liquid circulation unit 504 (which is not illustrated in FIG. 1A) to be described later. In the liquid ejection head 300, ejection ports that eject an ink containing a colorant in the form of droplets in a Z direction are arranged at a predetermined pitch in a Y direction.

In FIG. 1B, a CPU 500 controls the entire apparatus 1 in accordance with programs stored in a ROM 501 while using a RAM 502 as a work area. For example, the CPU 500 subjects image data, which is received from an externally connected host apparatus 600, to prescribed image processing in accordance with the programs and parameters stored in the ROM 501, thus generating ejection data for causing the liquid ejection head 300 to eject the inks. The liquid ejection head is driven in accordance with the ejection data, whereby the inks are ejected at a predetermined frequency. In the course of the aforementioned ejecting operation by the liquid ejection head 300, a conveyance motor 503 is driven to convey the sheet S in the X direction at a speed corresponding to the ejection frequency. Thus, an image in conformity to the image data received from the host apparatus 600 is printed on the sheet S.

The liquid circulation unit 504 is a unit for supplying the liquids (the inks) to the liquid ejection head 300 while circulating the inks. The liquid circulation unit 504 controls the entire system for circulating the inks, including a liquid supply unit 220 to be described later, as well as a negative pressure control unit 3, a switching mechanism 4, and the like under the control of the CPU 500.

(Fluid Flow Passages Inside Printing Apparatus)

Fluid flow passages of the entire inkjet printing apparatus will be described. FIGS. 2 to 5 are schematic diagrams showing liquid flow passages (ink flow passages) inside the liquid ejection apparatus (the inkjet printing apparatus) according to a first embodiment of the present invention.

Figure 2:
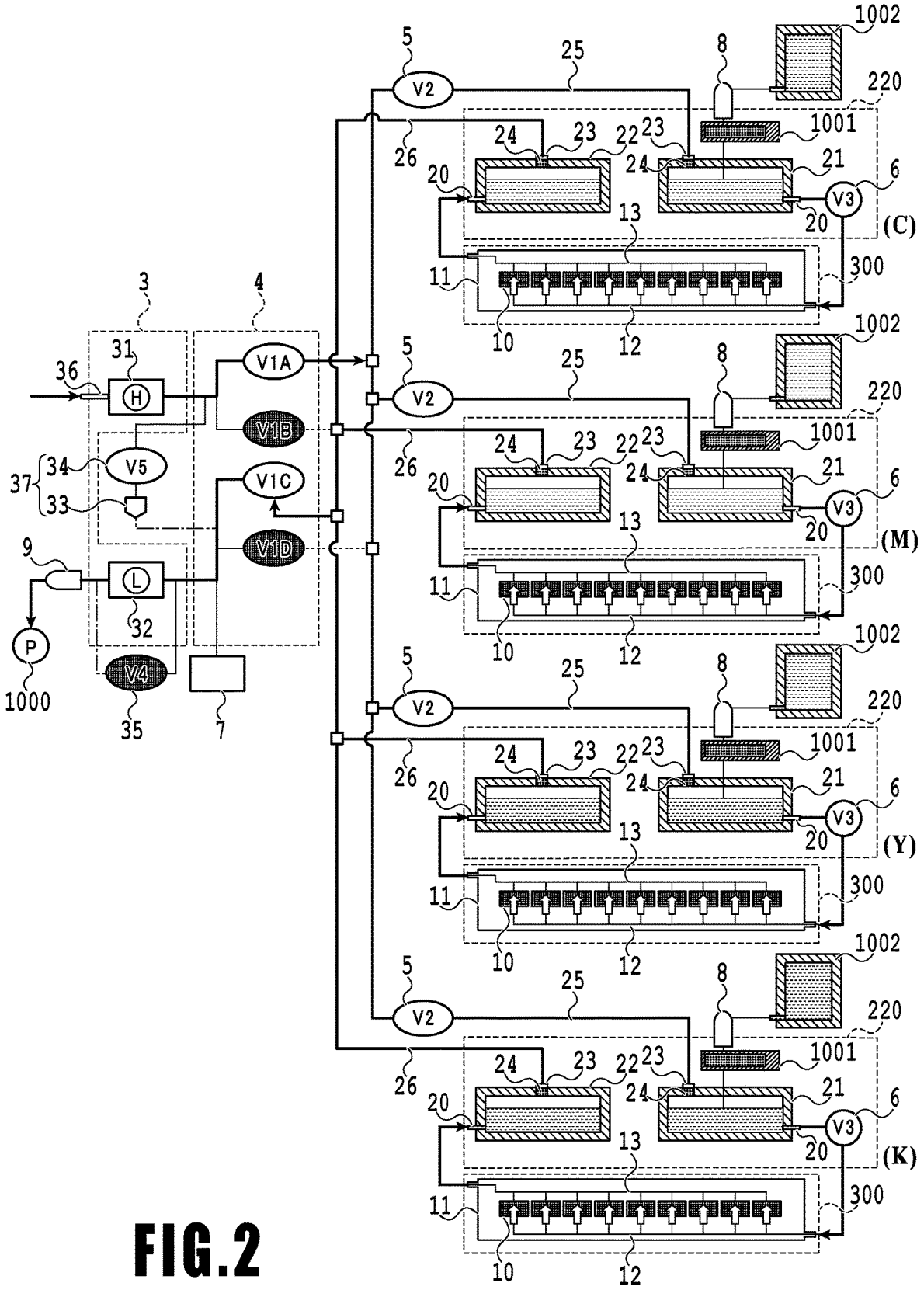
FIG. 2 is a schematic diagram showing a state of ink channels in the printing apparatus of FIG. 1A.

The liquid ejection head 300 is connected to first tanks 21 and second tanks 22 that store the inks (the liquids) of four colors, namely, C (cyan), M (magenta), Y (yellow), and K (black), respectively. In order to facilitate the understanding, FIG. 2 illustrates the liquid ejection head 300 while breaking it down depending on the inks of the respective colors. In reality, however, the ink flow passages for all the four colors are formed in the single liquid ejection head 300, and the ink flow passages for each ink color are connected to the corresponding tanks.

FIG. 2 is a schematic diagram showing the fluid flow passages (the ink flow passages and gas flow passages) in a state of standby for a printing operation (a non-printing state) by the printing apparatus. A main tank 1002 which is capable of storing a large volume of the ink and is also replaceable is connected to the first tank 21 for the ink of each color through a filter 1001 and an ink joint 8. The main tank 1002 includes an outside air communication hole (not shown). Accordingly, when the ink in the ink flow passages is consumed in association with an ejecting operation and a maintenance process (such as suction recovery) of the liquid ejection head 300, the first tank 21 can be refilled with the ink from the main tank 1002 in response to a signal from a residual amount detection mechanism (not shown) in the first tank.

The ink of the corresponding color is stored in the first tank 21 and the second tank 22, and there are an air portion (an upper layer) and an ink portion (a lower layer) in each tank in an ordinary state. Meanwhile, an air connection port 23 to establish communication between the air portion and the outside is provided in an upper wall of each of the first tank and the second tank, while an ink connection port 20 to connect the ink portion and the liquid ejection head 300 is provided at a lower portion of a side wall thereof.

The air can go into and out of the first tank 21 and the second tank 22 through the respective air connection ports 23. A gas-liquid separation membrane 24 is provided at the air connection port of each of the first tank 21 and the second tank 22. The gas-liquid separation membrane 24 has a function to prevent the ink from penetrating into an air pipe (an air channel) and causing color mixture in case of the occurrence of a rollover like a main body of the printing apparatus falling sideways. To this end, the gas-liquid separation membrane 24 preferably has low flow resistance and low ink permeability. For example, a water-repellent filter can be used favorably.

The air connection port 23 of the first tank 21 for each color is connected to the switching mechanism 4 in common through an individual valve 5 (indicated as V2). The air connection ports 23 of the second tanks for the respective colors are connected to the common switching mechanism 4 without the intermediary of other valves. As described above, a first pressure adjustment passage 25 for adjusting a pressure inside the first tank 21 is connected to the air connection port 23 of each first tank 21. Likewise, a second pressure adjustment passage 26 is connected to the air connection port 23 of each second tank 22. Both the first pressure adjustment passage 25 and the second pressure adjustment passage 26 are connected to the switching mechanism 4 and the negative pressure control unit 3.

The ink portion of the first tank is liquid-connected to the liquid ejection head 300 through a supply valve 6 (indicated as V3), and communicates with a first common flow passage 12 that corresponds to each color and is located in the liquid ejection head 300. The ink portion of the second tank 22 is connected to the liquid ejection head 300 without the intermediary of other valves, and communicates with a second common flow passage 13 that corresponds to each color and is located in the liquid ejection head 300.

A unit formed from the first tank 21, the second tank 22, the filter 1001, and the supply valve (V3) will be hereinafter referred to as the liquid supply unit 220. This embodiment describes a state of integrating these constituents of the liquid supply unit 220. However, these constituents may be provided independently of and separately from one another.

The switching mechanism 4 includes four on-off valves (indicated as VIA, VIB, VIC, and VID), and acts on a cyan circulation channel (C), a magenta circulation channel (M), a yellow circulation channel (Y), and a black circulation channel (K) in common. To be more precise, one side of each of a first on-off valve V1A and a fourth on-off valve V1D is connected to the air connection ports 23 of the four first tanks 21. One side of each of a second on-off valve V1B and a third on-off valve V1C is connected to the air connection ports 23 of the four second tanks 22. The other side of each of the first on-off valve V1A and the second on-off valve V1B is connected to a first pressure control mechanism 31(H) in the negative pressure control unit 3. The other side of each of the third on-off valve V1C and the fourth on-off valve V1D is connected to a second pressure control mechanism 32(L) in the negative pressure control unit 3.

The switching mechanism 4 can variously switch relations of connection among the air portions of the first tank 21 and the second tank 22 for the respective colors, the first pressure control mechanism 31, and the second pressure control mechanism 32 by appropriately switching on states and off states of the four on-off valves V1A to V1D. In the following, the on-off valves V1A and V1B connected to the first pressure control mechanism will be collectively referred to as a first switching portion while the on-off valves V1C and V1D connected to the second pressure control mechanism will be collectively referred to as a second switching portion.

Fluid channels in this embodiment include flow passages (channels) to circulate the liquids (the inks) used for ejection, and flow passages (channels) to circulate the gas (the air) used in pressure control for ejecting the liquids. Since flow directions of the liquids and of the gas corresponds to each another, the term "flow direction" or "flowing direction" will be used to represent these directions in common.

Now, the first pressure control mechanism (also referred to as a first pressure control unit) 31 and the second pressure control mechanism (also referred to as a second pressure control unit) 32 will be described.

The first pressure control mechanism 31 and the second pressure control mechanism 32 are so-called a decompression regulator mechanism and a back-pressure regulator mechanism, respectively, each of which includes a valve, a spring, a flexible film and the like in the inside. Each of the first pressure control mechanism 31 and the second pressure control mechanism 32 has a function to maintain the negative pressure of the air portion of each tank connected thereto within a predetermined pressure range (a range of a prescribed pressure).

The second pressure control mechanism 32 is connected to a suction pump 1000 (P) through a vacuum joint 9. A negative pressure in a space on an upstream side of the second pressure control mechanism 32 is adjusted within a predetermined range by driving the suction pump P. The suction pump 1000 may also be a vacuum pump. The first pressure control mechanism 31 is connected to an atmosphere communication port 36 depending on the degree of negative pressure in the inside, and adjusts a negative pressure in a space on a downstream side of the first pressure control mechanism 31 within a predetermined range.

In this way, the first pressure control mechanism 31 and the second pressure control mechanism 32 can stabilize the pressures on the downstream side and the upstream side of the respective mechanisms within the predetermined ranges by the operation of the internal valves, springs, and the like even in the case of changes in flow volume of the inks passing through the ink flow passages. While details of the first pressure control mechanism 31 and the second pressure control mechanism 32 will be described later, a control pressure of the second pressure control mechanism is set to a lower pressure than a control pressure of the first pressure control mechanism.

An air buffer 7 is provided between the second pressure control mechanism 32 and the third on-off valve V1C as well as the fourth on-off valve V1D. The air buffer 7 has a function to prevent the ink from dripping off the ejection port due to an environmental change in the case where an unused state of the printing apparatus continues over a long period. Specifically, in the case of expansion of the air at the air portion in the tank connected to the second pressure control mechanism 32 due to changes in environmental temperature and atmospheric pressure, the air buffer 7 that communicates with the air portion bulges with the expanded air, thus restraining application of a pressure to the liquid ejection head (a printing element board in particular). As an example, the air buffer 7 in the form of bag-shaped rubber or a spring bag having a weak spring inside can be favorably used.

In FIG. 2, an upstream end of the first switching portion (V1A and V1B) is connected to a downstream side of the first pressure control mechanism 31(H), and a downstream end of the second switching portion (V1C and V1D) is connected to an upstream side of the second pressure control mechanism 32(L). In FIG. 2, the on-off valves V1A and V1C are open while the on-off valves V1B and V1D are closed. In this instance, the first pressure control mechanism 31(H) is connected to the first tanks 21 for the respective colors through the on-off valve V1A, while the second pressure control mechanism 32(L) is connected to the second tanks 22 for the respective colors through the on-off valve V1C.

Figure 3:
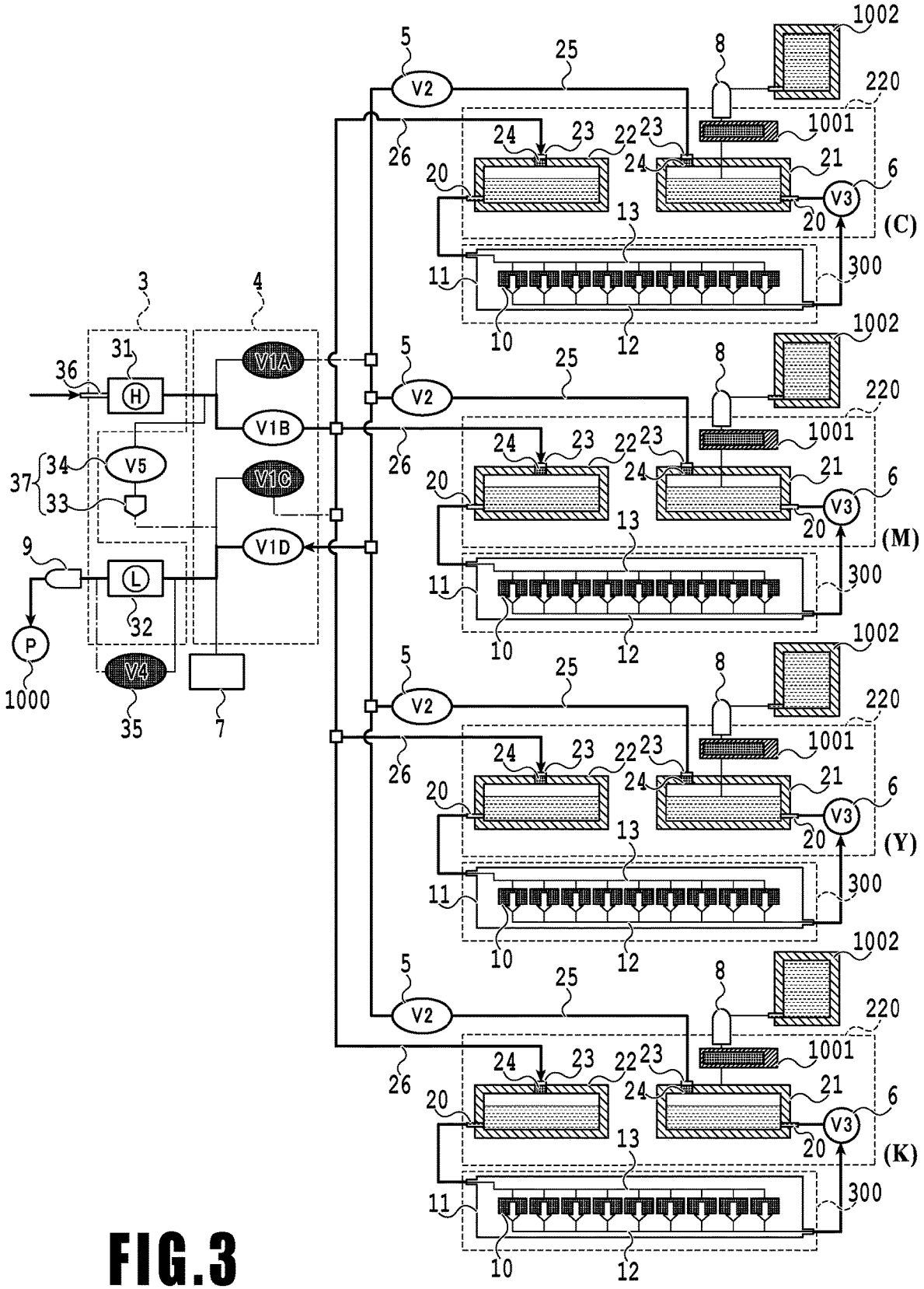
FIG. 3 is a schematic diagram showing another state of the ink channels of FIG. 2.

In contrast to FIG. 2, FIG. 3 shows the case where the on-off valves V1A and V1C are closed while the on-off valves V1B and V1D are open. In this case, the first pressure control mechanism 31(H) is connected to the second tanks 22 for the respective colors through the open valve V1B and the second pressure control mechanism 32(L) is connected to the first tanks 21 for the respective colors through the open valve V1D.

As described above, it is possible to bilaterally switch the relations of connection among the first pressure control mechanism 31(H), the second pressure control mechanism 32(L), and the first tanks 21 as well as the second tanks 22 for the respective colors by the opening and closing operations of the on-off valves V1A to V1D.

The aforementioned switching operations are conducted by the CPU 500, which performs determination based on various conditions such as signals from the ink residual amount detection mechanisms (not shown) in the first tanks 21 and the second tanks 22 for the respective colors, and controls the four on-off valves V1A to V1D. For example, the CPU 500 may perform the aforementioned switching at the timing when a residual amount of the liquid in the tank on the upstream side reaches a lower limit, or may perform the aforementioned switching at the timing when the flow of the liquid in the same direction is continued for a predetermined period of time. The above-described switching operation of each on-off valve is performed in the state where the liquid ejection head 300 suspends the ejecting operation. Nonetheless, the switching operation itself can be completed in several seconds and is therefore not regarded as a problem in light of downtime of the printing apparatus.

The switching mechanism 4 only needs to have the function to switch the states of connection as described above, and is not limited only to the aspect of the simple combination of the four on-off valves as described in this embodiment. For example, the switching mechanism 4 may adopt an aspect in which the first and second switching portions are formed by using a three-way valve and two slide valves.

(Fluid Flow Passages When Driving And When Refilling)

In FIG. 2, the individual valve 5 (V2) and the supply valve 6 (V3) are opened to operate the suction pump 1000(P). Thus, a differential pressure is generated between each tank (the first tank 21) connected to the first pressure control mechanism 31(H) side and each of tank (the second tank 22) connected to the second pressure control mechanism 32(L) side. Accordingly, flows of the inks from the first common flow passages 12 toward the second common flow passages 13 while passing through the respective printing element boards 10 (directions of outlined arrows in FIG. 2) occur inside the liquid ejection head 300. To be more precise, the flow of the ink which passes a pressure chamber 123 (FIG. 14) provided with a printing element inside as well as the vicinity of the ejection ports communicating with the pressure chamber 123 occurs between each first common flow passage 12 and the corresponding second common flow passage 13. As a consequence, bubbles, thickened inks, foreign matters, and the like in the vicinity of the ejection ports not ejecting the ink (the ejection ports in a non-ejecting state) can be discharged to the second tanks 22.

In any of the second tanks 22 for the respective colors, when an amount of the ink in the second tank 22 is increased by the ink flowing from the first tank 21 through the liquid ejection head 300 and a liquid level of the ink exceeds a preset high water detection level, the switching mechanism 4 inverts the relation of connection among the first tanks 21, the second tanks 22, the first pressure control mechanism 31(H), and the second pressure control mechanism 32(L). FIG. 3 shows this aspect. Specifically, the second tanks 22 are connected to the first pressure control mechanism 31(H) side and the first tanks 21 are connected to the second pressure control mechanism 32(L) side. Accordingly, flows of the inks from the second common flow passages 13 toward the first common flow passages 12 while passing through the respective printing element boards 10 (directions of outlined arrows in FIG. 3) occur this time, whereby bubbles, thickened inks, foreign matters, and the like are discharged to the first tanks 21.

Thereafter, when a liquid level of the ink in any of the first tanks 21 exceeds a high water detection level or when the liquid level of the ink in any of the second tanks 22 falls below a low water detection level, the switching mechanism inverts the relation of connection again. From the perspective of stability of ink ejected from the ejection port, it is preferably that the above-described inverting operation is performed in the state where the printing operation is suspended. Nonetheless, the time for the switching operation is no longer than several seconds and therefore does not impose a serious problem in light of downtime of the printing apparatus 1.

An amount of ink in the circulation channel is decreased by ejecting ink from the ejection port of the liquid ejection head 300. Therefore, an operation to refill the first tank 21 with the ink from the main tank 1002 is performed when the liquid level of the ink in the second tank 22 falls below the low water detection level and the liquid level of the ink in the first tank 21 falls below the high water detection level. In this case, the supply valves 6 (V3) corresponding to the respective colors are closed and the individual valves 5 (V2) are opened to begin with. Next, the switching mechanism 4 performs the switching so as to connect the first tanks to the second pressure control mechanism and to connect the second tanks to the first pressure control mechanism (that is to say, to establish the state shown in FIG. 3). Then, a bypass valve 35 (V4) is opened (a bypass channel is opened) while operating the suction pump 1000. Specifically, in the state where the first tanks 21 and the liquid ejection head 300 are separated from one another in terms of pressure by using the supply valves 6 (V3), the inside of each first tank is set to a highly negative pressure so as to refill the first tank with the ink in the main tank 1002. In this instance, it is likely that required refill amounts with the inks vary among the first tanks corresponding to the respective colors. However, by closing the individual valve 5 (V2) depending on each color based on a high water level detection signal from the first tank corresponding to each color, it is possible to prevent each first tank from being refilled with the excessive ink.

During the above-mentioned ink refilling operation, a negative static pressure is applied from the first pressure control mechanism 31(H) to the ejection ports of each printing element board 10 through the corresponding second tank 22. Thus, a meniscus of the ink at each ejection port is stably retained. Regarding the inks of all colors, the liquid levels of the inks in the second tanks 22 for the respective colors are in the state below the low water detection levels at the point of completion of refilling the first tanks 21 with the inks. Hence, it is possible to cause the inks to flow from the first tanks 21 to the second tanks 22 just by opening the supply valves 6 (V3) and the individual valves 5 (V2) while inverting the switching mechanism 4. Accordingly, it is possible to start the stable printing operation at once while requiring only a short time (no longer than several seconds) for the operation to switch the valves.

A normal state (an on-off state when power is off) of the individual valve 5 (V2) and/or the supply valve 6 (V3) is a closed state, and the first switching portion (V1A and V1D) is preferably open to the first tank 21 side while the second switching portion (V1B and V1C) is preferably open to the second tank 22 side. Specifically, in examples shown in FIGS. 2 to 5, the valves V1A and V1C are open while the valves V1B and V1D are closed in the normal state of the four on-off valves (V1A to V1D). By setting as described above, the liquid ejection head 300 establishes a state of being separated from the first tanks 21 in terms of pressure and communicating only with the second tanks 22 when the printing apparatus is off. Since the second tanks are connected to the second pressure control mechanism 32(L) where the control pressure is low, the negative pressure applied to a nozzle portion of the liquid ejection head can be kept at a relatively high state. Accordingly, it is possible to increase the degree of layout freedom inside the apparatus in such a way as to set the tanks at positions higher than the liquid ejection head while preventing the inks from dripping off the ejection ports. Moreover, even when the orientation of the printing apparatus is slightly inclined in case of indoor transportation when the power is off, for example, it is possible to inhibit the inks from leaking out of the ejection ports.

As described above, the ink supply system of this embodiment can conduct the pressure control necessary for the flows of the inks of the respective colors by using the pressure control mechanisms and the pump that are common to the inks of all the colors. In this way, it is possible to provide the highly reliable printing apparatus which is capable of printing an image at high image quality while removing bubbles, thickened inks, foreign matters, and the like from the ejection ports in spite of being small in size and formed from a small number of components at low costs. In this embodiment, four-color inks are used. The pressure control mechanism is commonly usable even if the kind of liquid further increase (for example, light color ink, special color ink, printing properties enhancing liquid, and the like).

In this embodiment, a mechanism unit formed from the pump 1000, the negative pressure control unit 3, and the switching mechanism 4 is connected to the first tanks 21 and the second tanks 22 through air piping having extremely slight pressure losses. Thus, this configuration makes it possible to select the layout of the mechanism unit in the printing apparatus relatively freely, and brings about an advantage of ease of downsizing the printing apparatus.

Meanwhile, a module formed from the liquid ejection head 300 and the liquid supply unit 220 may be unitized into a liquid ejection head and interchangeably installed in a carriage of a main body of the printing apparatus. When the liquid ejection head 300 and the liquid supply unit 220 are unitized (integrated), the liquid ejection head can be simply replaced just by detaching the main tank 1002 and the air piping. Moreover, the liquid ejection head is connected only by use of the mechanism unit and the air piping in the main body of the printing apparatus. Accordingly, there is no risk of leakage or scatter of the inks at the time of replacement by unitizing the main tank 1002 together as the liquid ejection head. Thus, it is possible to replace the liquid ejection head more easily.

In the meantime, the liquid ejection head of this embodiment adopts a mode of a line head of a page-wide type. Instead, the liquid ejection head may adopt a mode of so-called a serial head. When the liquid ejection head adopts the mode of the serial head, the mechanism unit is installed outside the carriage while a head unit is connected to the mechanism unit by using the air piping, and only the head unit is mounted on the carriage and allowed to move back and forth. Thus, the liquid ejection head can conduct the printing while discharging thickened inks and foreign matters to the tanks.

(Negative Pressure Compensating Function)

In the ink supply system of this embodiment, the flow of the ink is generated in the liquid ejection head 300 by using the differential pressure between each first tank 21 and the corresponding second tank 22. When the ink is ejected from the ejection ports of the liquid ejection head, the refilling of a pressure chamber with the ink takes place.

In the following, a flow volume of an ink passing through an ink flow passage in the printing element board 10 at the time of not operating ejection from the ejection ports (hereinafter also referred to as "when not operating ejection") will be referred to as an ink flow volume when not operating ejection. Meanwhile, an amount of ejection of the ink at the time of operating ejection (hereinafter also referred to as "when operating ejection") will be referred to as an ink ejection amount when operating ejection.

The refill of the respective pressure chambers from the tanks substantially connected to the first pressure control mechanism 31(H) takes place in the case where the ink flow volume when not operating ejection is equal to or above the ink ejection amount when operating ejection.

On the other hand, in the case where the ink ejection amount when operating ejection is larger than the ink flow volume when not operating ejection, the refill of the respective pressure chambers takes place not only from the tanks connected to the first pressure control mechanism 31(H) but also from the tanks connected to the second pressure control mechanism 32(L). For example, at the time of printing under so-called high duty conditions such as a case of conducting the printing in such a way as to eject a large amount of the ink in a short time, and a case where the liquid ejection head performs numerous printing operations at a high frequency, the refill from the tanks connected to the second pressure control mechanism 32(L) is more apt to take place.

Nonetheless, the second pressure control mechanism 32(L) (a general back-pressure regulator) is kept from causing a back-flow because a valve in the inside is autonomously closed in case of the back-flow. Moreover, the pump 1000 is also designed not to cause a back-flow by using a check valve in the inside. For this reason, when the high duty printing is performed, the pressure in each tank connected to the second pressure control mechanism 32(L) may get too low to cause the insufficient refill in the ink flow passage in the printing element board 10. As a consequence, an amount of ink ejected from the ejection port reduces, and the image may be diluted or blurred.

On the other hand, at a different printing element board 10 and ejection ports not performing the high duty printing, the increase in flow volume of the passing ink causes a rise in negative pressure and an excessive drop in temperature, and may lead to a deterioration in image quality like again.

In this embodiment, a compensation mechanism 37 for a variation in negative pressure (hereinafter also referred to as a negative pressure compensation mechanism, a negative pressure compensating section, or a pressure compensation unit) is provided in order to avoid the aforementioned circumstance. The negative pressure compensation mechanism 37 is provided on a channel that establishes gas communication from the first tanks 21 to the second tanks 22. The negative pressure compensation mechanism 37 is formed from a passive valve 33 and an on-off valve 34 (indicated as V5), and is provided on the channel (a communication passage) that directly connects a downstream side flow passage of the first pressure control mechanism 31 to an upstream side flow passage of the second pressure control mechanism 32.

The passive valve 33 is designed to be opened when a differential pressure between two sides thereof, namely, a differential pressure between the pressure on the first pressure control mechanism 31 side and the pressure on the second pressure control mechanism 32 side is equal to or above a predetermined value, for example, equal to or above a differential pressure between the control pressure of the first pressure control mechanism 31 and the control pressure of the second pressure control mechanism 32. In an example of FIG. 4, the pressure on the first pressure control mechanism 31 side corresponds to an internal pressure of a flow passage between the first pressure control mechanism 31 and the first tank 21. Meanwhile, the pressure on the second pressure control mechanism 32 side corresponds to an internal pressure of a flow passage between the second pressure control mechanism 32 and the second tank 22. According to the above-described configuration, even when the pressure on the second pressure control mechanism 32 side is reduced (the negative pressure therein is increased) by the ejecting operation of the liquid ejection head 300, the variation in negative pressure is compensated for by opening the passive valve 33, and an excessive increase in negative pressure is thus prevented. For example, when the pressure on the second pressure control mechanism 32 side is equal to or below a predetermined pressure, the pressure in the second pressure control mechanism 32 side is increased by supplying the liquid to the second pressure control mechanism 32 side from the first pressure control mechanism 31 side. Thus, such a reduction in pressure can be compensated. In this way, the ink can be stably ejected from the ejection ports of each printing element board 10 even at the time of high duty printing.

Figure 4:
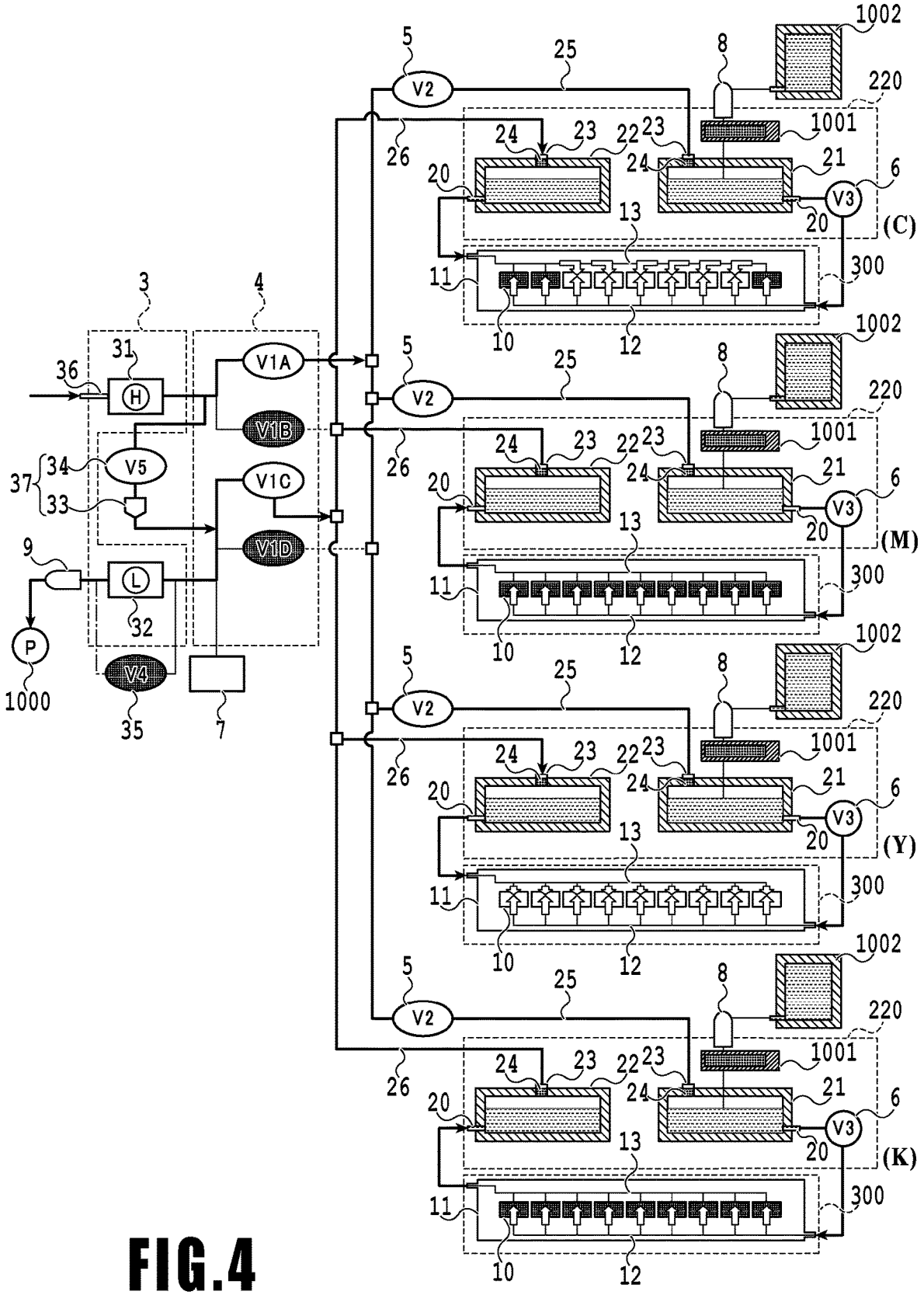
FIG. 4 is a schematic diagram showing still another state of the ink channels of FIG. 2.

Of all the printing element boards 10 in FIG. 4, the printing element boards 10 indicated with outlines are in the state where the high duty printing is going on. Meanwhile, the printing element boards 10 indicated with hatching are in the state where the ejecting operation is not going on (in the non-ejecting state) or in the state where the printing elements are driven at low duty.

The high duty printing is going on at a substantial part (an outlined part) of the printing element board for the color C (cyan) and the entire part (an outlined part) of the printing element board for the color Y, which are being refilled with the inks from the second tanks 22. Accordingly, the air corresponding to the amount of refill with the ink is supplied from the first pressure control mechanism 31 through the passive valve 33 in order to suppress the increase in negative pressure in each of the second tanks 22 for the color C and the color Y, thereby suppressing the increase in negative pressure. For this reason, the internal pressure in each of the second tanks 22 for the color M and the color K in the standby state is nearly unchanged and the stable flow of the ink is thus continued. In a liquid ejection head having a plurality of printing element boards, as a page-wide type in this embodiment, the refill mode is different according to a printing duty of each printing element board 10 as in the liquid ejection head 300 for C (cyan) as shown in FIG. 4. That is, the printing element board driven at low duty is refilled with ink only from the first tank 21 side. Meanwhile, the printing element board driven at high duty is refilled with ink from both of the first tank 21 side and the second tank 22 side.

As described above, according to this embodiment, it is possible to suppress an excessive increase in negative pressure inside the tank connected to the second pressure control mechanism 32 in any condition.

(Strong Recovery Mode)

This embodiment can further execute a strong recovery mode in order to discharge bubbles, thickened inks, foreign matters, and the like in the ejection ports and the flow passages inside the liquid ejection head 300, which are failed to be completely discharged at ordinary ink flow volumes.

Figure 5:
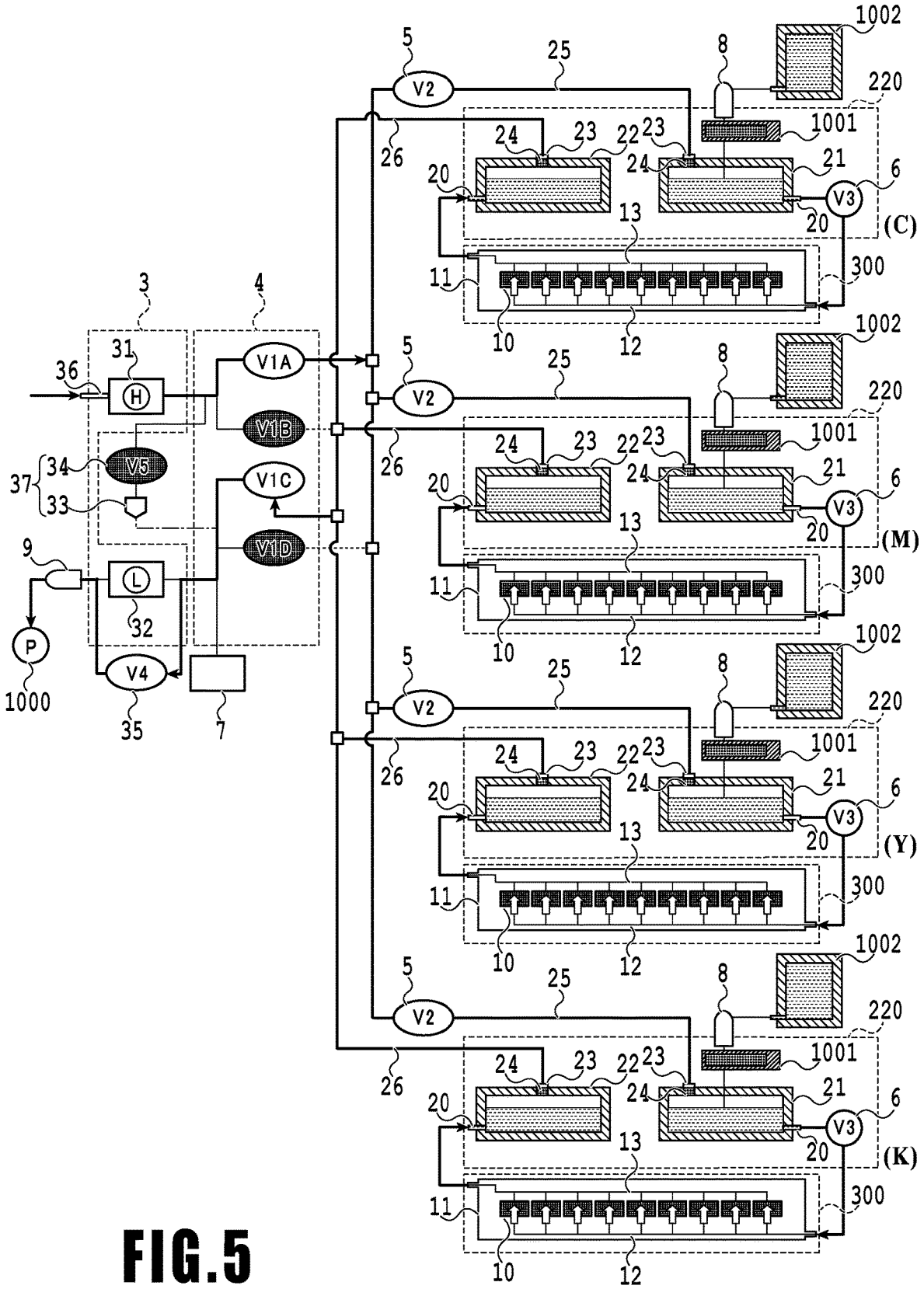
FIG. 5 is a schematic diagram showing yet another state of the ink channels of FIG. 2.

FIG. 5 is a schematic diagram showing a state of the channels in the strong recovery mode. The bypass valve 35 (indicated as V4) connected between the flow passage on the upstream side of the second pressure control mechanism 32(L) and the flow passage on the downstream side thereof is open. Thus, it is possible to control the differential pressure between each first tank 21 and the corresponding second tank 22 depending on the number of revolutions of the suction pump 1000 irrespective of the control pressure of the second pressure control mechanism 32. In other words, the flow volume of the ink passing through the liquid ejection head 300 can be increased more than that in the usual circulation described above. The flow volume of the ink passing through the liquid ejection head 300 can be selected within a range that enables to retain the meniscus of the ink at each ejection port and in consideration of a recovery property of the ejection performance of the liquid ejection head. This strong recovery mode is carried out in the non-printing state. Accordingly, the flow volume of the ink passing through the liquid ejection head 300 does not cause any problem even if the flow volume brings about a negative pressure that is more than appropriate for providing an ejection characteristic suitable for the printing.

A flow passage at an ejection port portion is usually the most delicate flow passage in the liquid ejection head. Accordingly, it is difficult to discharge the bubbles, the foreign matters, and the like accumulated on the upstream side in the ink flow direction (a flowing direction of the liquid) of the ejection port even if the ink flow volume is increased. For this reason, after the execution of the strong recovery mode just for a predetermined period of time, it is preferable to invert the ink flow direction in the liquid ejection head 300 by the operation of the switching mechanism 4 and then to execute the strong recovery mode again. According to the strong recovery mode as described above, it is possible to conduct an operation to recover the ejection port without causing a large amount of waste ink unlike a conventional operation to recover the liquid ejection head associated with a suctioning operation and a pressurizing operation. Thus, it is possible to achieve reduction in waste ink and simplification of a recovery mechanism.

Here, when executing the strong recovery mode, it is necessary to perform the control in such a way as to close the on-off valve 34 (indicated as V5) of the negative pressure compensation mechanism described above. This is due to the following reason. Specifically, the pressure is applied in the strong recovery mode so as to generate the differential pressure that is larger than usual between the first tank and the second tank. Accordingly, if the on-off valve 34 is open, it is not possible to achieve the large differential pressure because the passive valve 33 is also opened. Alternatively, it is also possible to impart a closing function to the passive valve 33.

(Liquid Supply Unit and Valve Unit)

Figure 6A:
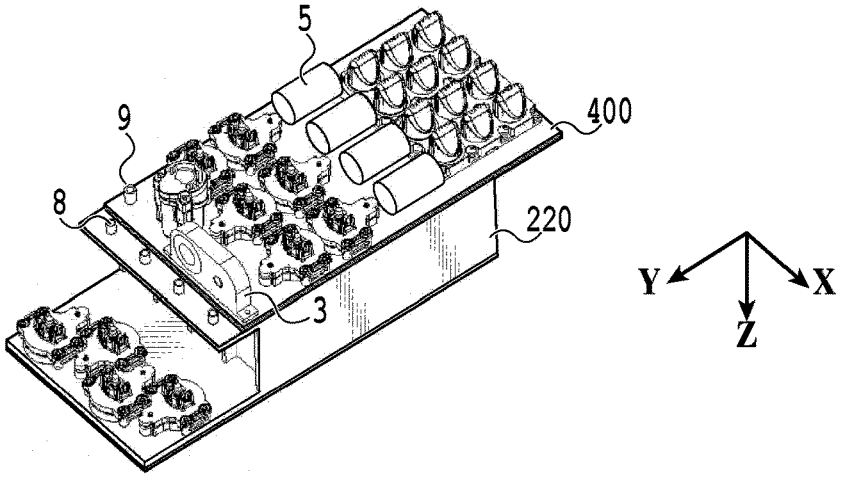
FIGS. 6A, 6B, and 6C are schematic diagrams showing a liquid supply unit and a valve unit in the first embodiment of the present invention.
Figure 6B:
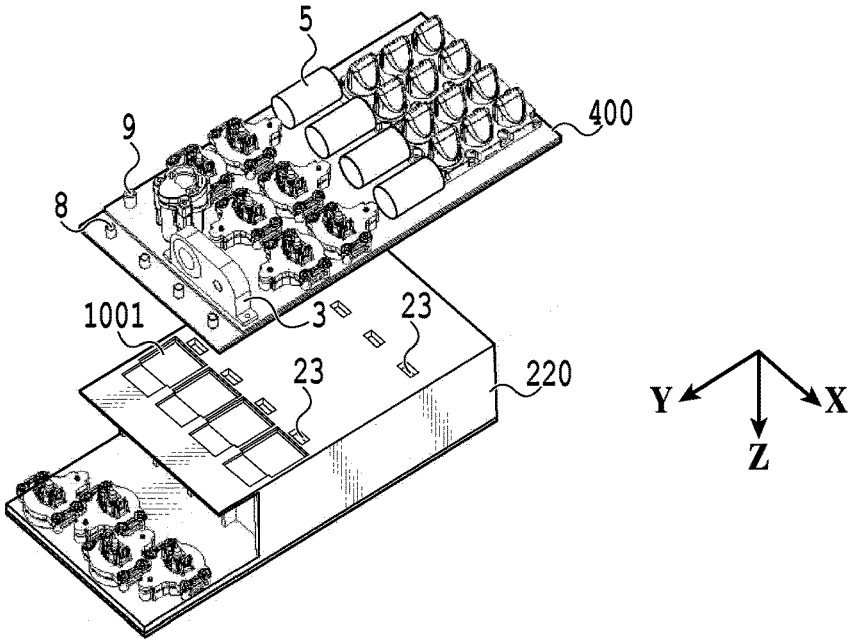
Figure 6C:
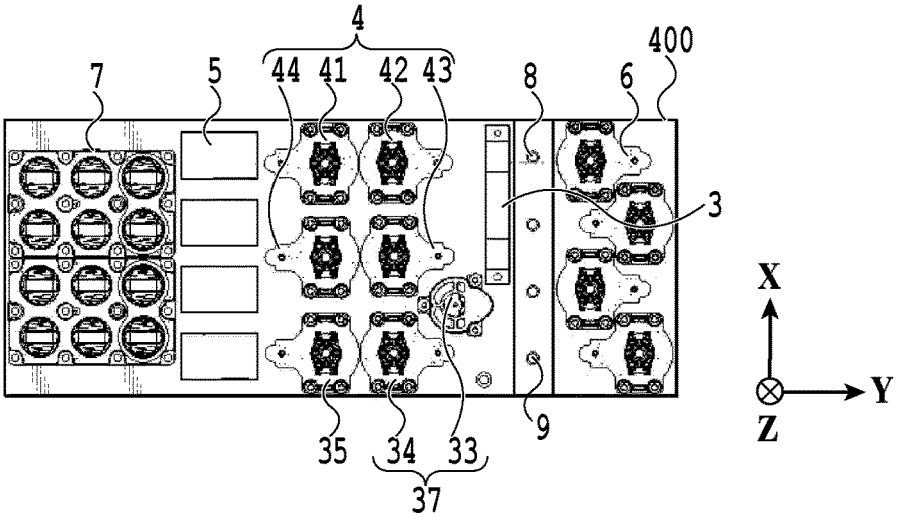

FIGS. 6A, 6B, and 6C are diagrams showing specific configurations of the liquid supply unit 220, a valve unit 400, and the negative pressure control unit 3.

The valve unit 400 is a mechanism unit which includes: the respective valves (V1A, V1B, V1C, V1D, V2, V3, V4, and V5) shown in FIGS. 2 to 5, the air buffers 7, the ink joints 8, the vacuum joint 9, and ink and air flow passage members. As shown in FIG. 6A, the valve unit 400 is provided with the ink joints 8 to be connected to the main tanks for the inks of four colors, and the vacuum joint 9 to be connected to the suction pump 1000. The joints communicate with the ink flow passages and the air passage inside the unit, respectively.

FIG. 6B is a perspective view showing a state where the liquid supply unit 220 and the valve unit 400 are separated from each other. As can be seen in FIG. 6B, the supplied ink flowing in from each ink joint 8 is passed through a filter 1001 in order to remove foreign matters in the ink and is then supplied to the first tank 21 in the inside. Meanwhile, the air portions of the first tank 21 and the second tank 22 of the liquid supply unit are connected to the air flow passage (not shown) in the valve unit 400 through the air connection ports 23.

FIG. 6C is a top view of the valve unit 400. The negative pressure control unit 3, the switching mechanism 4 (on-off valves 41 to 44), the four individual valves 5 each formed from an electromagnetic valve, the negative pressure compensation mechanism 37 formed from the passive valve 33 and the on-off valve 34, the bypass valve 35, the four supply valves 6, and the air buffers 7 are set up in a planar fashion on the valve unit 400. Among them, the on-off valves 41 to 44 and 34, the bypass valve 35, and the supply valves 6 are subjected to on-off control by being mechanically connected to gear-cam mechanisms (not shown) in the main body of the printing apparatus, respectively. There is no problem in light of the functional perspective if these valves apply electromagnetic valves as with the individual valves 5. In the meantime, the individual valves 5 may be subjected to the on-off control by gear-cam mechanisms in the main body. Here, the four supply valves 6 perform on-off operations simultaneously for the inks of all colors. In this regard, the mechanical control by using the mechanisms requires lower costs than individually using the electromagnetic valves. Meanwhile, the individual valves 5 need to be on-off controlled depending on the colors of the inks (depending on the types of the liquids). In this regard, the electrical control requires lower costs than preparing motors as well as the mechanisms depending on the colors of the inks.

As shown in FIG. 2, both of the first pressure control mechanism 31(H) and the second pressure control mechanism 32(L) are built into the negative pressure control unit 3 set up on the valve unit 400. It is possible to stabilize the negative pressure inside each flow passage of the liquid ejection head 300 within a certain range by the operations of the valves, the spring members, and the like which are installed inside the first pressure control mechanism 31(H) and the second pressure control mechanism 32(L), respectively. Details of the structure of the negative pressure control unit 3 will be described later with reference to FIGS. 12A and 12B.

(Specific Configuration of Liquid Ejection Head)

A specific configuration of the liquid ejection head 300 of this embodiment will be described with reference to FIGS. 7A, 7B, and 8.

Figure 7A:
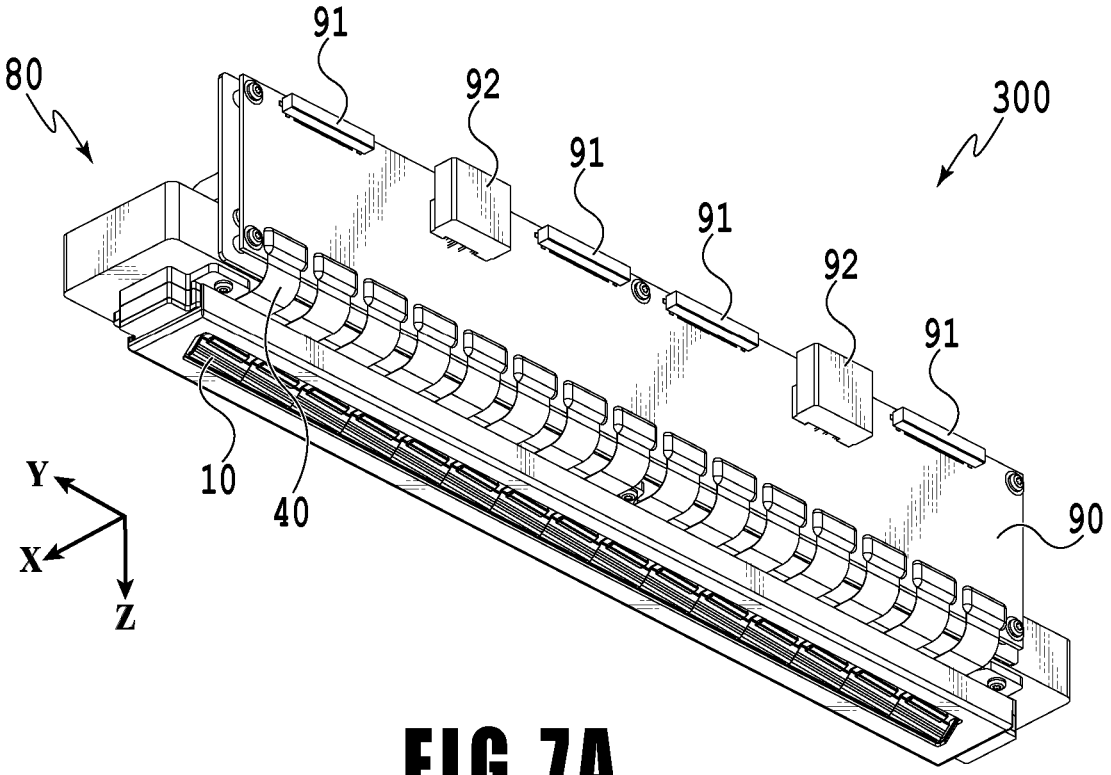
FIGS. 7A and 7B are perspective views showing a liquid ejection head in the first embodiment of the present invention.
Figure 7B:
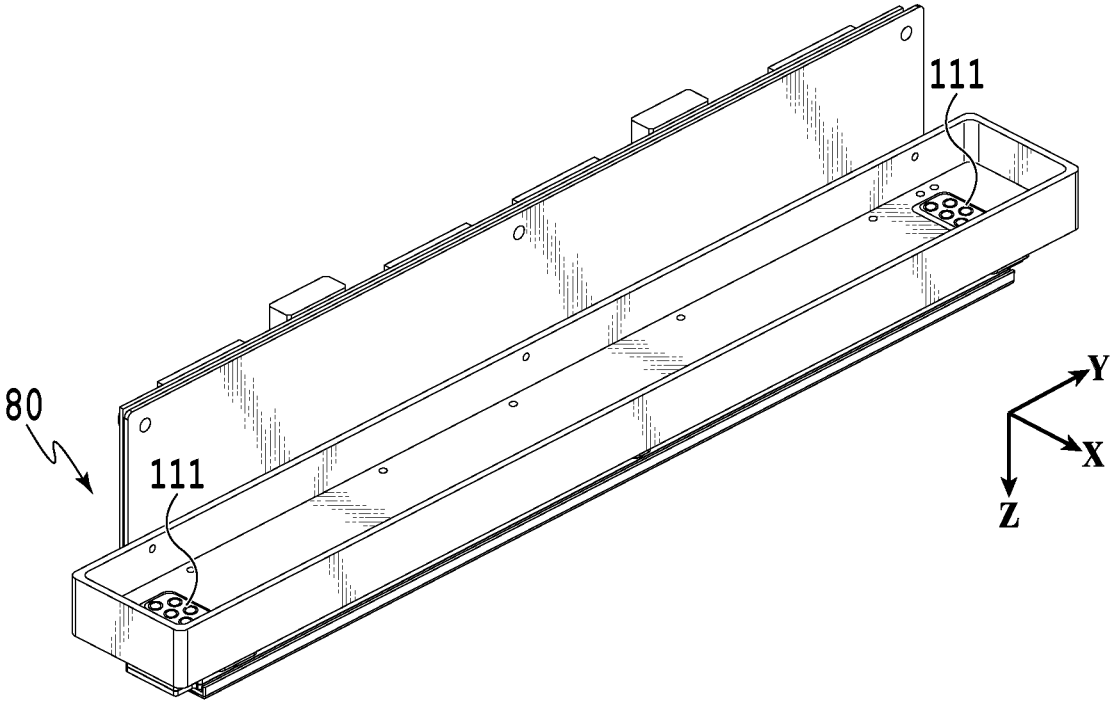

FIGS. 7A and 7B are perspective views of the liquid ejection head 300 of this embodiment. The liquid ejection head 300 of this embodiment is a liquid ejection head of a line type in which fifteen printing element boards 10 are linearly arranged (set up in line). Each printing element board 10 is capable of ejecting the inks of four colors of C (cyan), M (magenta), Y (yellow), and K (black).

The liquid ejection head 300 includes signal input terminals 91 and power supply terminals 92, which are electrically connected to the respective printing element boards 10 through flexible wiring boards 40 and an electrical wiring board 90. The signal input terminals 91 and the power supply terminals 92 are electrically connected to a control unit of the printing apparatus 1, and supply ejection driving signals and electric power necessary for the ejection to the printing element boards 10. By consolidating the wiring by use of electrical circuits in the electrical wiring board 90, it is possible to reduce the number of the signal input terminals 91 and the number of the power supply terminals 92 less than the number of the printing element boards 10. In this way, when attaching the liquid ejection head 300 to the printing apparatus 1 or when replacing the liquid ejection head 300, the number of electric contacts to be disconnected can be reduced.

Liquid connectors 111 provided on two end portions of the liquid ejection head 300 are connected to the first tanks and the second tanks for the respective colors in the liquid supply unit 220.

Figure 8:
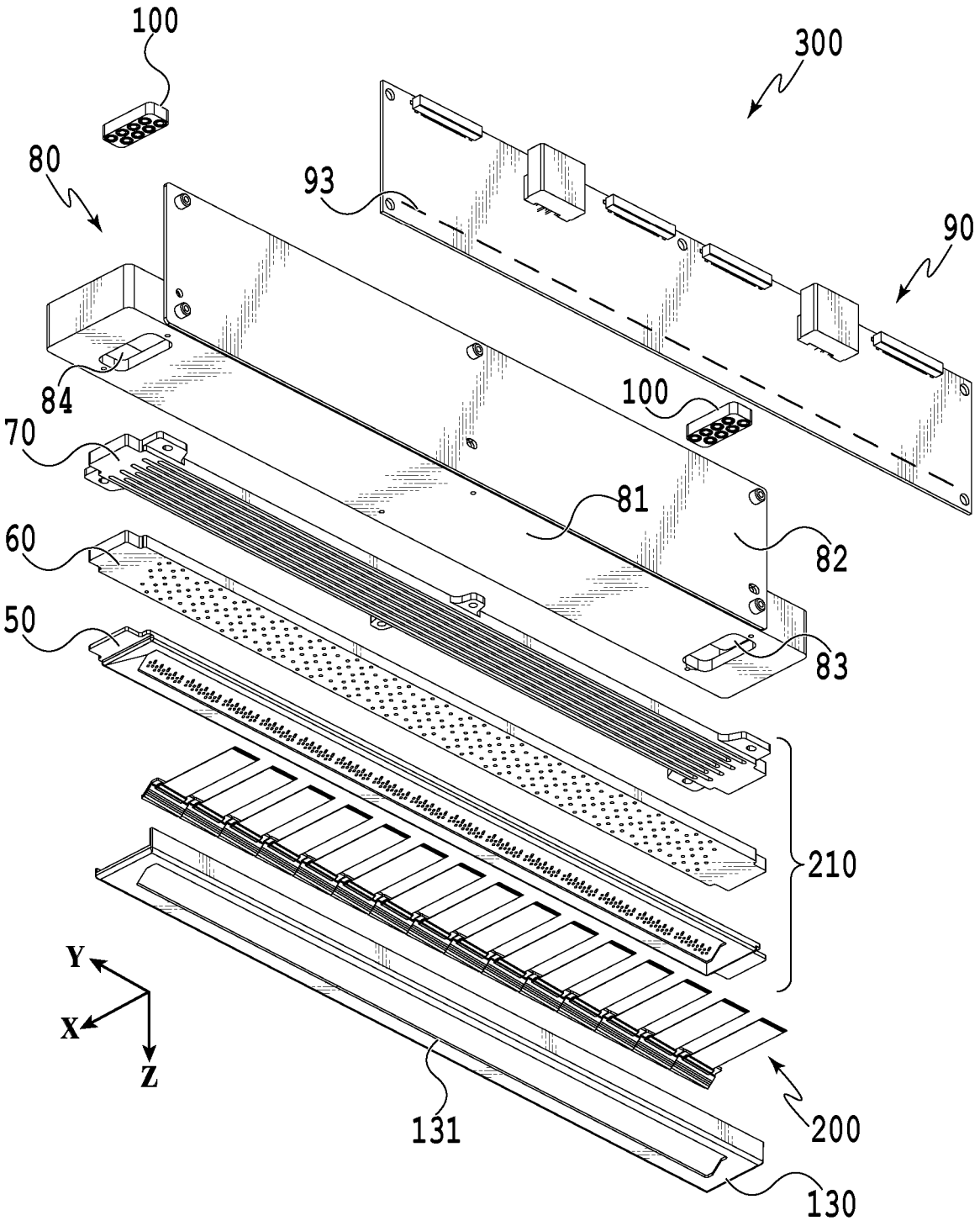
FIG. 8 is an exploded perspective view of the liquid ejection head of FIG. 7A.

FIG. 8 is an exploded perspective view of components and units that constitute the liquid ejection head 300.

A housing 80 includes a support portion 81 to support the liquid ejection head 300 and a support portion 82 to support the electrical wiring board 90, and ensures the rigidity of the entire liquid ejection head. A flow passage member 210 mounting ejection modules 200 is fitted to the support portion 81. The support portion 82 and the support portion 81 are fixed to the housing 80 with screws. The support portion 81 corrects a warpage or a deformation of the liquid ejection head 300 and ensures relative positional accuracy of the multiple element boards 10, thereby suppressing the occurrence of stripes or unevenness in density in a printed image. For this reason, the support portion 81 preferably has sufficient rigidity, and a metallic material such as SUS and aluminum or a ceramic such as alumina is a material suitable therefor. The support portion 81 is provided with openings 83 and 84 to allow insertion of rubber joints 100. The inks supplied from the liquid supply unit 220 are passed through holes in the rubber joints 100 and guided to a third flow passage member 70 that constitutes the ink ejection head 300.

A cover member 130 is fitted to a surface of the liquid ejection head 300 opposed to a printing medium. As shown in FIG. 8, the cover member 130 is a frame-like member provided with an elongated opening 131. The printing element boards 10 and sealing members 110 (see FIG. 12A) included in the ejection modules 200 are exposed from the opening 131. A frame part around the opening 131 functions as a contact surface to come into contact with a cap member that caps the liquid ejection head 300 during the standby for the printing. For this reason, it is preferable to fill asperities and gaps on an ejection port surface of the liquid ejection head 300 by coating any of an adhesive, a sealant, a filler, and the like along the periphery of the opening 131, so as to form a closed space at the time of capping.

Next, details of the flow passage member 210 included in the liquid ejection head 300 will be described. As shown in FIG. 8, the flow passage member 210 is formed by stacking a first flow passage member 50, a second flow passage member 60, and the third flow passage member 70. The flow passage member 210 is a flow passage member for distributing the liquids supplied from the liquid supply unit 220 to the respective ejection modules 200 and to return the liquids circulated in the ejection modules 200 back to the liquid supply unit 220. The flow passage member 210 is fixed to the liquid ejection head support portion 81 with screws. Thus, a warpage and a deformation of the flow passage member 210 are suppressed.

Figure 9:
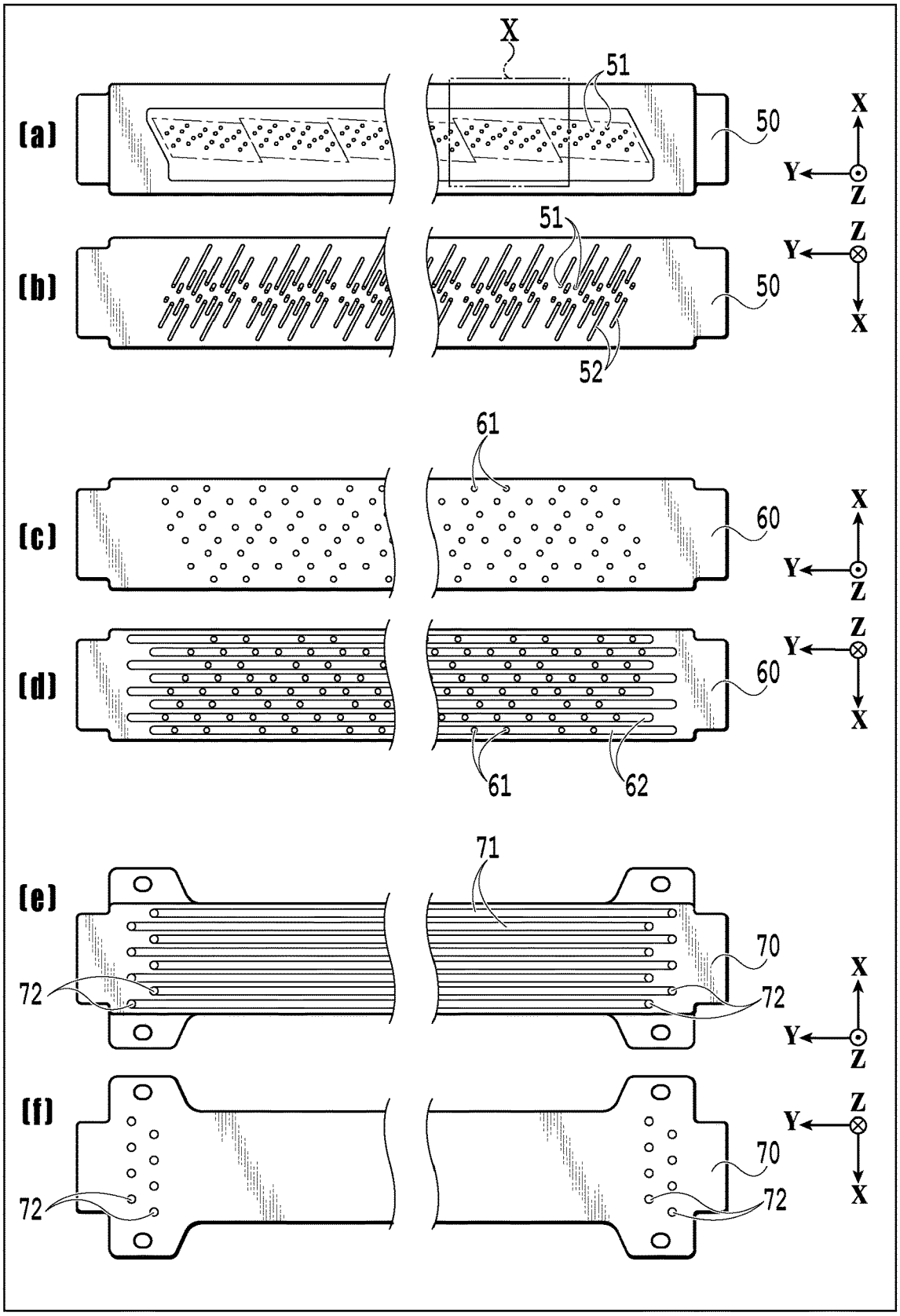
FIG. 9 shows schematic diagrams illustrating flow passage members that constitute the liquid ejection head of FIG. 7A.

Parts (a) to (f) in FIG. 9 illustrate diagrams showing front surfaces and rear surfaces of the first, second, and third flow passage members. In FIG. 9, part (a) shows a surface of the first flow passage member 50 on which the ejection modules 200 are mounted, while part (f) shows a surface of the third flow passage member 70 which comes into contact with the liquid ejection head support portion 81. The first flow passage member 50 is joined to the second flow passage member 60 such that a surface of part (b) of FIG. 9 and a surface of part (c) of FIG. 9 serving as contact surfaces of these members are opposed to each other. The second flow passage member is joined to the third flow passage member such that a surface of part (d) of FIG. 9 and a surface of part (e) of FIG. 9 serving as contact surfaces of these members are opposed to each other. By joining the second flow passage member 60 to the third flow passage member 70, the eight common flow passages extending in a longitudinal direction of the flow passage members are formed by using common flow passage grooves 62 and 71 defined therein. Thus, the set of the first common flow passage 12 and the second common flow passage 13 for each color are formed in the flow passage member 210. Communication ports 72 of the third flow passage member 70 fluidically communicate with the liquid supply unit 220 through respective holes in the rubber joints 100. Multiple communication ports 61 are formed in bottom surfaces of the common flow passage grooves 62 of the second flow passage member 60, and the communication ports 61 communicate with end portions of individual flow passage grooves 52 of the first flow passage member 50. Communication ports 51 are formed on other end portions of the individual flow passage grooves 52 of the first flow passage member, and the communication ports 51 fluidically communicate with the multiple ejection modules 200. Flow passages toward the center of the flow passage members can be intensively formed by using the individual flow passage grooves 52.

Each of the first, second, and third flow passage members is preferably made of a material having corrosion resistance to the liquids and a low linear expansion coefficient. For example, a composite material (a resin material) prepared by adding an inorganic filler (particulates, fibers, and the like) of silica or alumina to any of alumina, LCP (a liquid crystal polymer), PPS (polyphenylene sulfide), and PSF (polysulfone) as a base material can be used suitably as the material. As for a method of forming the flow passage member 210, the three flow passage members may be stacked and attached to one another. Alternatively, a method of bonding by welding is applicable when a resin-composite resin material is selected as the material.

Figure 10:
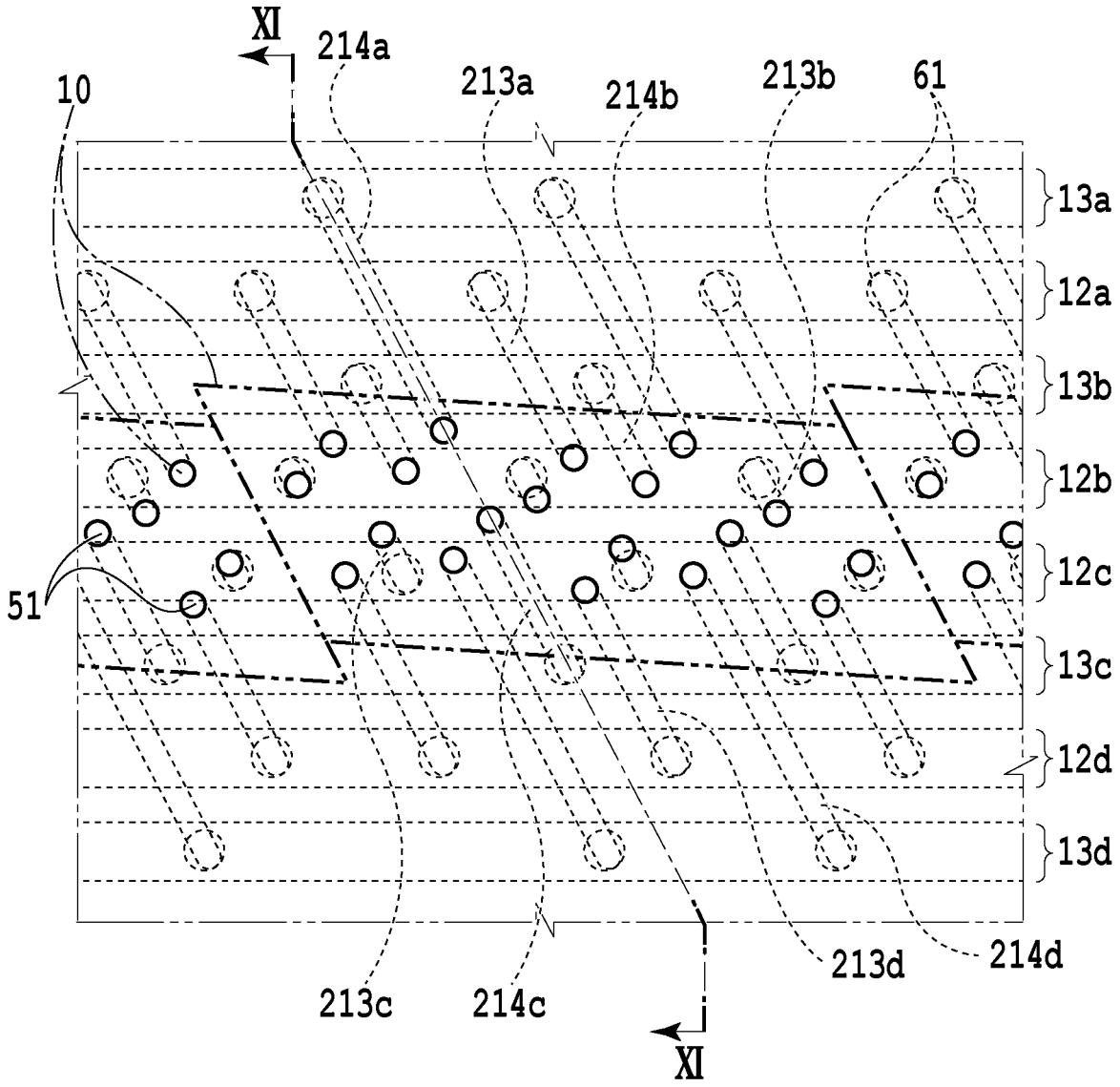
FIG. 10 is an enlarged view of a portion X in FIG. 9.

Next, the relations of connection among the respective flow passages in the flow passage member 210 will be described with reference to FIG. 10. FIG. 10 is an enlarged perspective view of part of the flow passages in the flow passage member 210 formed by joining the first, second, and third flow passage members, which is viewed in the direction from the surface of the first flow passage member 50 on which the ejection modules 200 are mounted. The flow passage member 210 includes the first common flow passages 12 (12*a*, 12*b*, 12*c*, and 12*d*) and the second common flow passages 13 (13*a*, 13*b*, 13*c*, and 13*d*) for the respective the colors, which extend in the longitudinal direction of the liquid ejection head 300. Multiple first individual flow passages (213*a*, 213*b*, 213*c*, and 213*d*) formed from the individual flow passage grooves 52 are connected to the first common flow passages 12 for the respective colors through the communication ports 61. Meanwhile, multiple second individual flow passages (214*a*, 214*b*, 214*c*, and 214*d*) formed from the individual flow passage grooves 52 are connected to the second common flow passages 13 for the respective colors through the communication ports 61. The above-described flow passage configuration makes it possible to intensively guide the inks from the respective first common flow passages 12 to the printing element boards 10, each of which is located at the central part of the corresponding flow passage member, through the set of the first individual flow passages 213. Moreover, this flow passage configuration makes it possible to transfer the inks from the printing element boards 10 to the respective second common flow passages 13 through the set of the second individual flow passages 214.

Figure 11:
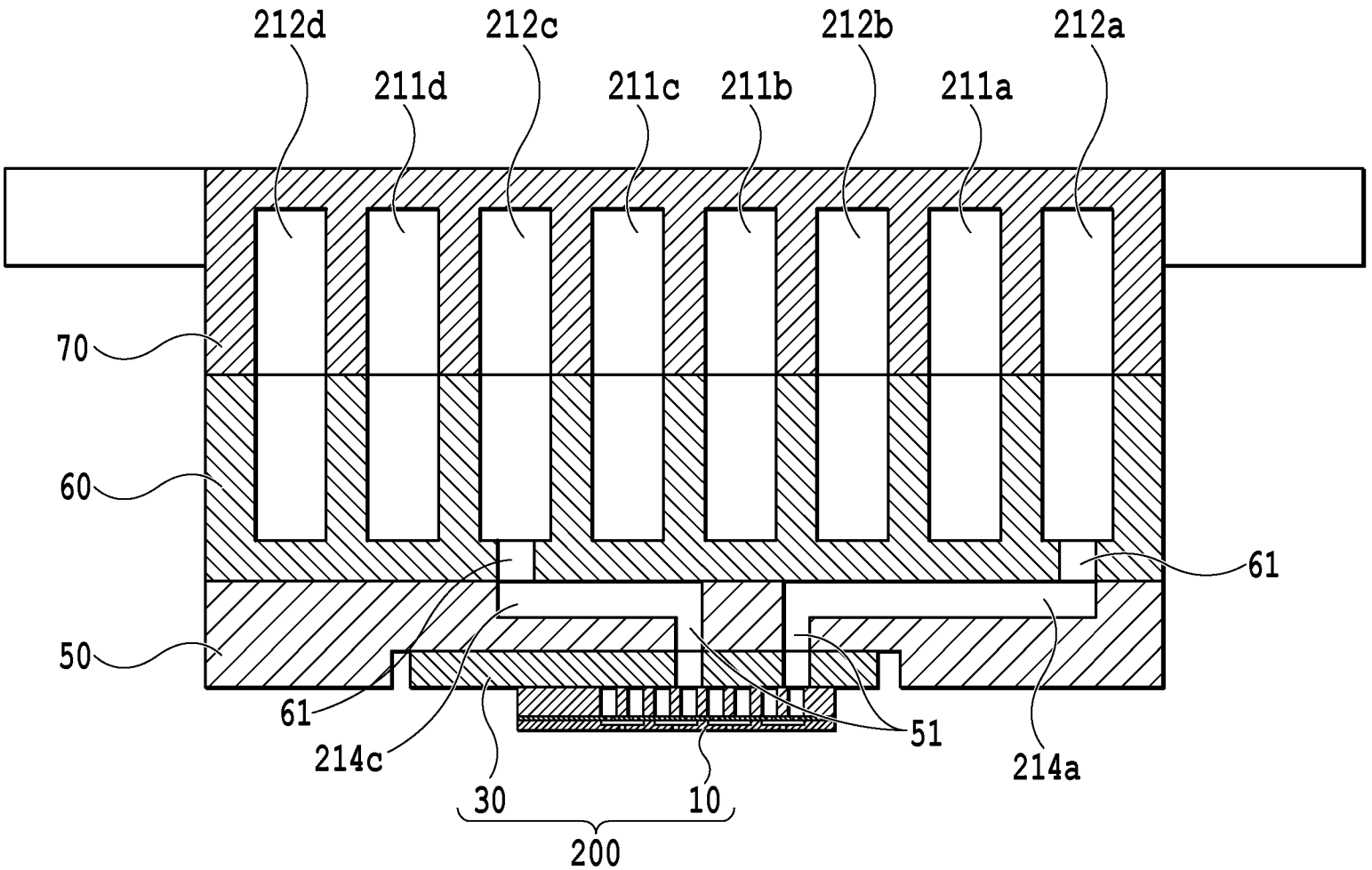
FIG. 11 is a cross-sectional view taken along the XI-XI line in FIG. 10.

FIG. 11 is a cross-sectional view taken along the XI-XI line in FIG. 10. As shown in FIG. 11, each of the second individual flow passages (214*a* and 214*c*) communicates with the ejection module 200 through the corresponding communication port 51. The cross-section in FIG. 11 illustrates only the second individual flow passages (214*a* and 214*c*). However, in another cross-section, the first individual flow passages 213 communicate with the ejection module 200 as shown in FIG. 10. Flow passages for supplying the ink from the first flow passage member 50 to printing elements 115 (see FIG. 14) on the printing element board 10 are formed in a support member 30 and the printing element board 10, which are included in each ejection module 200. Meanwhile, flow passages for recovering (circulating) all or part of the liquid supplied to the printing elements 115 back to the first flow passage member 50 are also formed therein.

When the inks are circulated as shown in FIG. 2, the first common flow passage 12 for each color is connected to the pressure control mechanism (high pressure side) 31 through the liquid supply unit 220 while the corresponding second common flow passage 13 is connected to the pressure control mechanism (low pressure side) 32 through the liquid supply unit 220. The differential pressure (a difference in pressure) between the first common flow passage 12 and the second common flow passage 13 is generated by the negative pressure control unit 3 including the pressure control mechanism (high pressure side) 31 and the pressure control mechanism (low pressure side) 32. As a consequence, the flow of the ink of each color flowing sequentially through the first common flow passage 12, the first individual flow passage 213*a*, the printing element board 10, the second individual flow passage 213*b*, and the second common flow passage 13 is generated in the liquid ejection head configured as shown in FIGS. 10 and 11.

In the meantime, when the inks are circulated as shown in FIG. 3, the first common flow passage 12 for each color is connected to the pressure control mechanism (low pressure side) 32 through the liquid supply unit 220 while the corresponding second common flow passage 13 is connected to the pressure control mechanism (high pressure side) 31 through the liquid supply unit 220. The differential pressure (the difference in pressure) between the first common flow passage 12 and the second common flow passage 13 is generated by the negative pressure control unit 3 including the pressure control mechanism (high pressure side) 31 and the pressure control mechanism (low pressure side) 32. As a consequence, the flow of the ink of each color flowing sequentially through the second common flow passage 13, the second individual flow passage 213*b*, the printing element board 10, the first individual flow passage 213*a*, and the first common flow passage 12 is generated in the liquid ejection head configured as shown in FIGS. 10 and 11.

(Ejection Module)

Figure 12A:
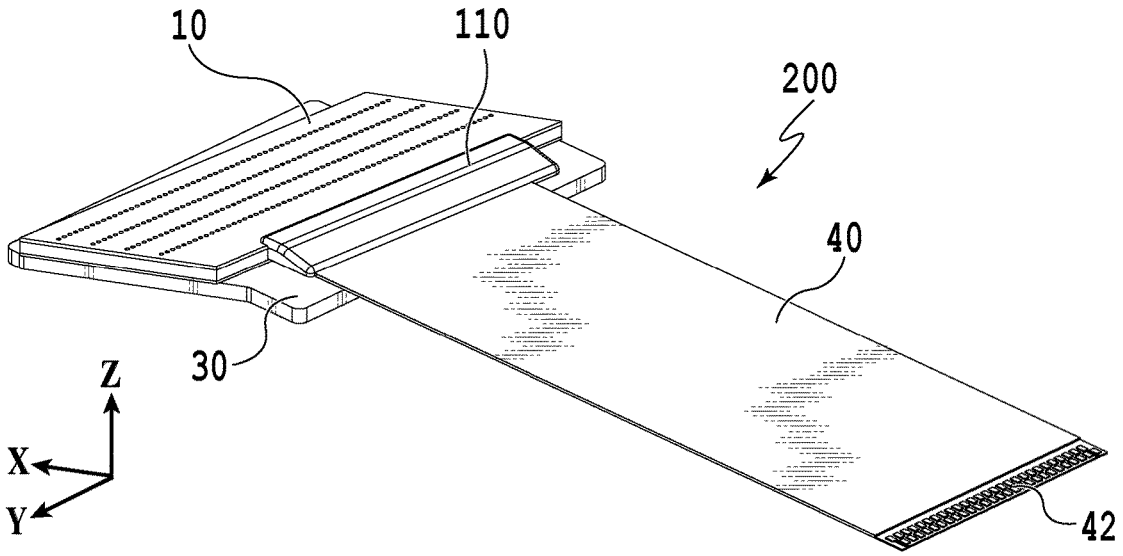
FIGS. 12A and 12B are perspective views of an ejection module in the first embodiment of the present invention.
Figure 12B:
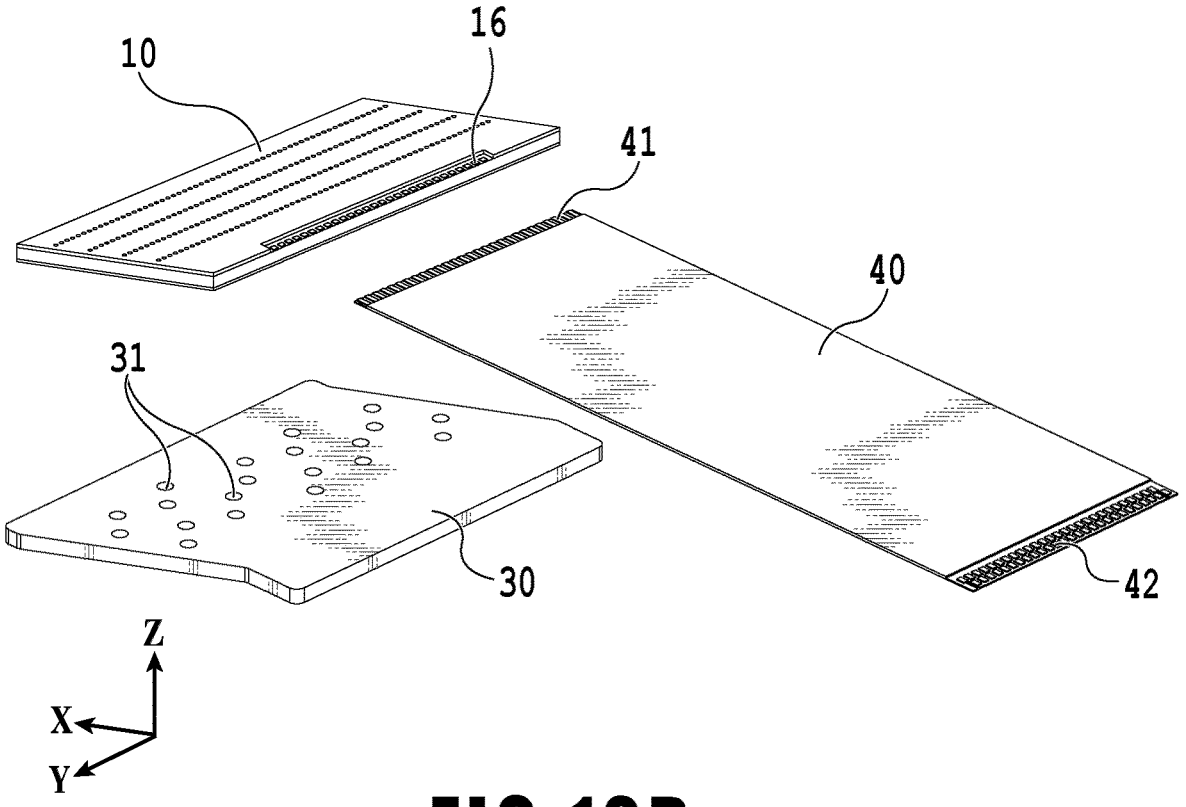

FIG. 12A is a perspective view of each ejection module 200 and FIG. 12B is an exploded diagram thereof. As for a method of manufacturing the ejection module 200, the printing element board 10 and the flexible wiring board 40 are first attached onto the support member 30 that is provided with liquid communication ports 31 in advance. Thereafter, terminals 16 on the printing element board 10 are electrically connected to terminals 41 on the flexible wiring board 40 by wire bonding, and then a wire-bonded portion (an electrically connected portion) is covered and sealed with the sealing member 110. Terminals 42 on the flexible wiring board 40 located on the opposite side from the printing element board 10 are electrically connected to connection terminals 93 (see FIG. 8) on the electrical wiring board 90. The support member 30 serves not only as a supporting medium to support the printing element board 10 but also as a flow passage member to establish the fluidic communication between the printing element board 10 and the flow passage member 210. Accordingly, the support member 30 is preferably provided with a high degree of flatness and capable of being joined to the printing element board with sufficiently high reliability. Examples of suitable materials for the support member 30 include alumina and resin materials.

(Structure of Printing Element Board)

A configuration of the printing element board 10 of this embodiment will be described.

Figure 13A:
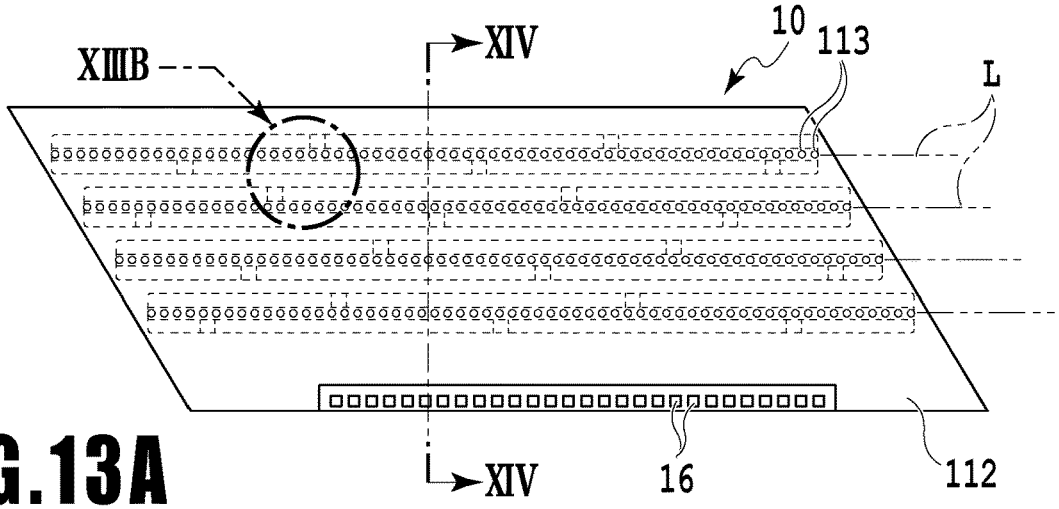
FIG. 13A is a plan view of a printing element board of the first embodiment of the present invention.
Figure 13B:
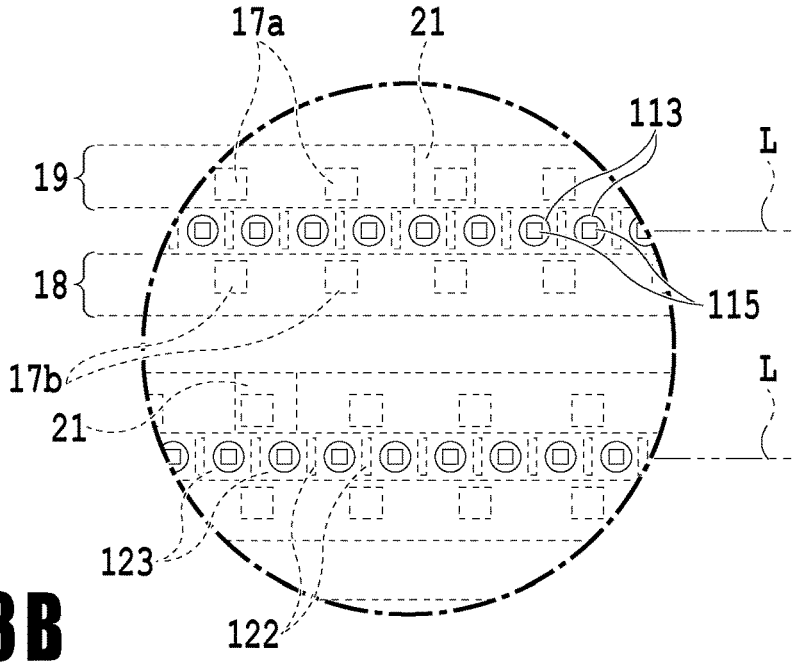
FIG. 13B is an enlarged view of a portion XIIIB in FIG. 13A.
Figure 13C:
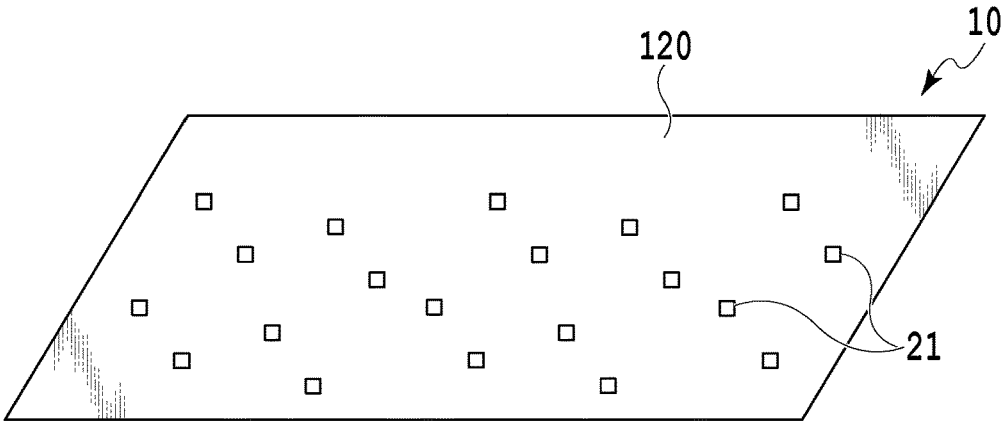
FIG. 13C is a back view of the printing element board in FIG. 13A.

FIG. 13A is a plan view of a surface of the printing element board 10 in which ejection ports 113 are formed, FIG. 13B is an enlarged view of a portion indicated with XIIIB in FIG. 13A, and FIG. 13C is a plan view on the other side of FIG. 13A. As shown in FIG. 13A, four rows of ejection ports corresponding to the respective ink colors are formed in an ejection port forming member 112 of the printing element board 10. Note that an extending direction of a row of ejection ports formed by arraying the multiple ejection ports 113 will be hereinafter referred to as an "ejection port row direction".

As shown in FIG. 13B, the printing elements 115 being heater elements for transforming the liquid into bubbles with thermal energy are located at positions corresponding to the respective ejection ports 113. Pressure chambers 123 containing the printing elements 115 inside are defined by partition walls 122. The printing elements 115 are electrically connected to the terminals 16 shown in FIG. 13A by using electric wiring (not shown) provided on the printing element board 10. Meanwhile, the printing elements 115 generate heat and bring the liquid into a boil based on pulse signals that are inputted from a control circuit of the printing apparatus 1 through an electric wiring board 90 (FIG. 8) and the flexible wiring board 40 (FIG. 12A). The liquid is ejected from each ejection port 113 with a force of a bubble (a bubble pressure) generated by the boil. As shown in FIG. 13B, along each row of the ejection ports, a liquid supply passage 18 extends on one side while a liquid recovery passage 19 extends on the other side. The liquid supply passage 18 and the liquid recovery passage 19 are flow passages extending in the ejection port row direction and being provided in the printing element board 10, and communicate with the ejection ports 113 through supply ports 17*a* and recovery ports 17*b*, respectively.

Although the terms "supply" and "recovery" are used as in the liquid supply passage 18, the liquid recovery passage 19, and the like in this specification in order to describe applicable configurations, the flow direction of the liquid is reversible in the embodiments of the present invention as shown in FIGS. 2 and 3, for example. In this context, the liquid may be recovered through the liquid supply passages and may be supplied from the liquid recovery passages depending on the flow direction of the liquid. Therefore, it is to be noted that the relation between the "supply" and the "recovery" may be inverted likewise in regard to other explanations in this specification when the flow direction of the liquid (the ink flow direction) is inverted.

Figure 14:
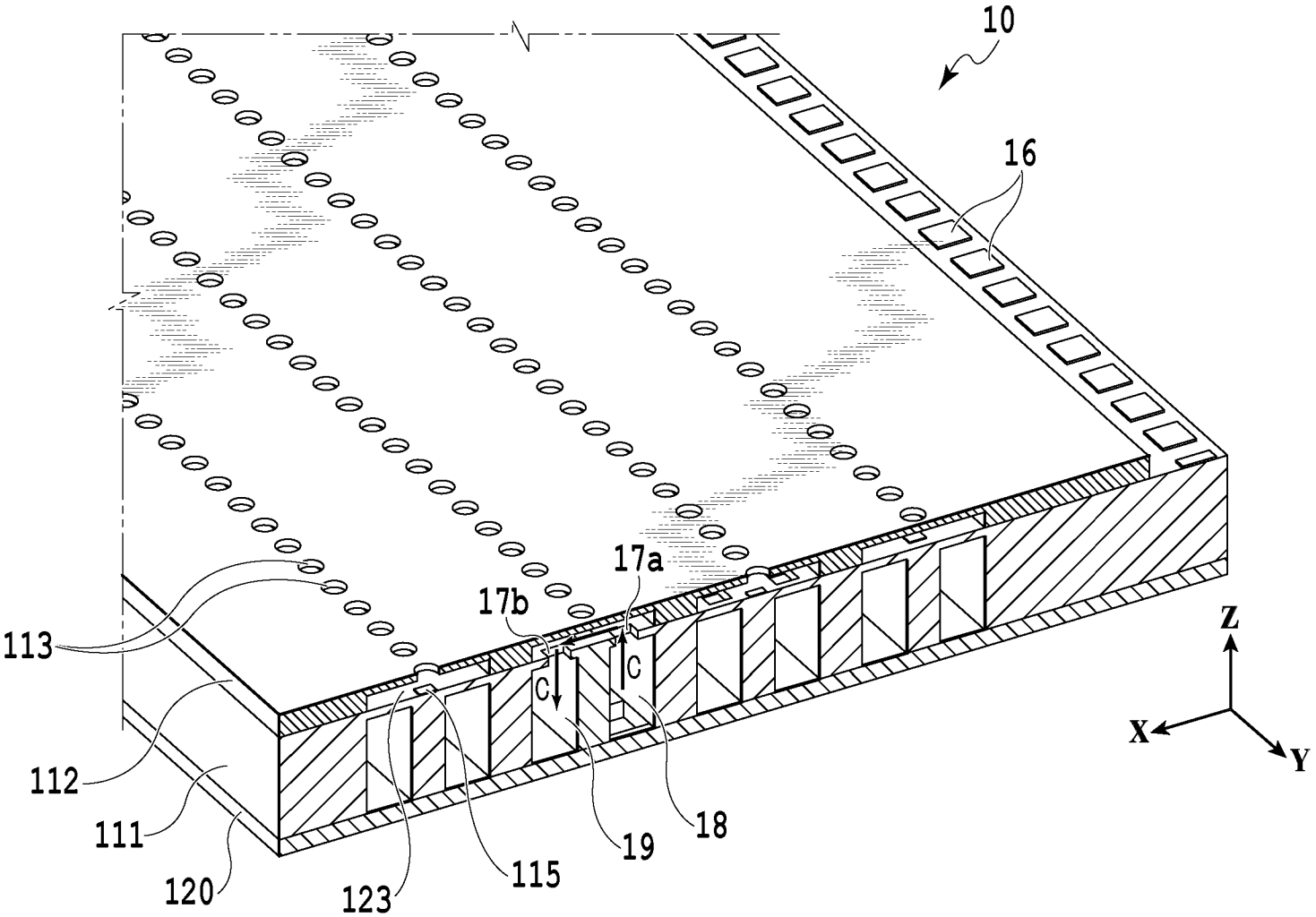
FIG. 14 is a cross-sectional view taken along the XIV-XIV line in FIG. 13A.

As shown in FIGS. 13C and 14, a lid member 120 in the form of a sheet is stacked on a surface of the printing element board 10 located opposite from the surface where the ejection ports 113 are provided. The lid member 120 is provided with multiple openings 21 that communicate with the liquid supply passages 18 and the liquid recovery passages 19 to be described later. In this embodiment, the lid member 120 is provided with three openings 21 for each liquid supply passage 18 and two openings 21 for each liquid recovery passage 19. The respective openings 21 in the lid member 120 shown in FIG. 13B communicate with the multiple communication ports 51 shown in part (a) of FIG. 9. FIG. 14 is a perspective view showing a cross-section of the printing element board 10 as well as the lid member 120, which is taken along the XIV-XIV line in FIG. 13A. As shown in FIG. 14, the lid member 120 has a function as a lid that constitutes part of a wall of each liquid supply passage 18 and part of a wall of each liquid recovery passage 19 formed in a substrate 111 of the printing element board 10. The lid member 120 is preferably formed of a material having sufficient corrosion resistance against the liquids. The lid member 120 is also required to have a high degree of accuracy in opening shapes and opening positions of the openings 21 from the viewpoint of preventing color mixture. As described above, the lid member is provided in order to change pitches of the flow passages by using the openings 21. Accordingly, the lid member preferably has a small thickness in light of pressure losses. For this reason, it is preferable to use a light-sensitive resin material or a silicon thin plate as the material of the lid member 120, and to form the openings 21 therein by a photolithographic process.

Next, flows of the liquid in the printing element boards 10 will be described. The printing element board 10 is formed by stacking the substrate 111 made of Si and the ejection port forming member 112 made of the light-sensitive resin, and the lid member 120 is bonded to a rear surface of the substrate 111. The printing elements 115 (FIG. 13B) are formed on one surface side of the substrate 111, while the grooves constituting the liquid supply passages 18 and the liquid recovery passages 19 extending along the rows of the ejection ports are formed in the back surface side thereof. The liquid supply passages 18 and the liquid recovery passages 19 formed from the substrate 111 and the lid member 120 are connected to a common supply flow passage 211 and a common recovery flow passage 212 in the flow passage member 210, and the differential pressure is generated between each liquid supply passage 18 and the corresponding liquid recovery passage 19. At the time of printing when the liquid is ejected from the multiple ejection ports 113 of the liquid ejection head 300, the liquid in the liquid supply passage 18 for each ejection port not performing the ejecting operation flows to the corresponding liquid recovery passage 19 via the supply port 17*a*, the pressure chamber 123, and the recovery port 17*b*. This flow is indicated with arrows C in FIG. 14. The flow makes it possible to transfer thickened inks, bubbles, foreign matters, and the like, which are caused in the ejection port 113 and the pressure chamber 123 that are suspending the printing due to evaporation from the ejection port 113, to the liquid recovery passage 19. Moreover, it is possible to suppress thickening of the ink in the ejection port 113 and the pressure chamber 123.

The liquid transferred to the liquid recovery passage 19 is passed through the opening 21 of the lid member 120 and the liquid communication port 31 of the support member 30, then sequentially transferred to the communication port 51, the individual recovery flow passage 214, and the second common flow passage 13, and eventually transferred to the first tank 21 or the second tank 22.

In other words, the liquid to be supplied from the first tank or the second tank of the liquid supply unit 220 to the liquid ejection head 300 flows in the order mentioned below, and is thus supplied and recovered. The liquid first flows out of the liquid supply unit 220 and into the liquid ejection head 300 through the liquid connector 111 and the rubber joint 100. Then, the liquid is supplied in the order of the communication port 72 as well as the common flow passage groove 71 provided in the third flow passage member, the common flow passage groove 62 as well as the communication port 61 provided in the second flow passage member, and the individual flow passage groove 52 and the communication port 51 provided in the first flow passage member. Thereafter, the liquid is supplied to the pressure chamber 123 sequentially through the liquid communication port 31 provided in the support member 30, the opening 21 provided in the lid member, and the liquid supply passage 18 and the supply port 17*a* provided in the substrate 111. Of the liquid supplied to the pressure chamber 123, a portion of the liquid not ejected from the ejection port 113 sequentially flows in the recovery port 17*b* as well as the liquid recovery passage 19 provided in the substrate 111, the opening 21 provided in the lid member, and the liquid communication port 31 provided in the support member 30. Then, the liquid sequentially flows in the communication port 51 as well as the individual flow passage groove 52 provided in the first flow passage member, the communication port 61 as well as the common flow passage groove 62 provided in the second flow passage member, the common flow passage groove 71 as well as the communication port 72 provided in the third flow passage member 70, and the rubber joint 100. Subsequently, the liquid is transferred form the liquid connector 111 to the second tank or the first tank of the supply unit 220.

(Positional Relation Between Printing Element Boards)

Figure 15:
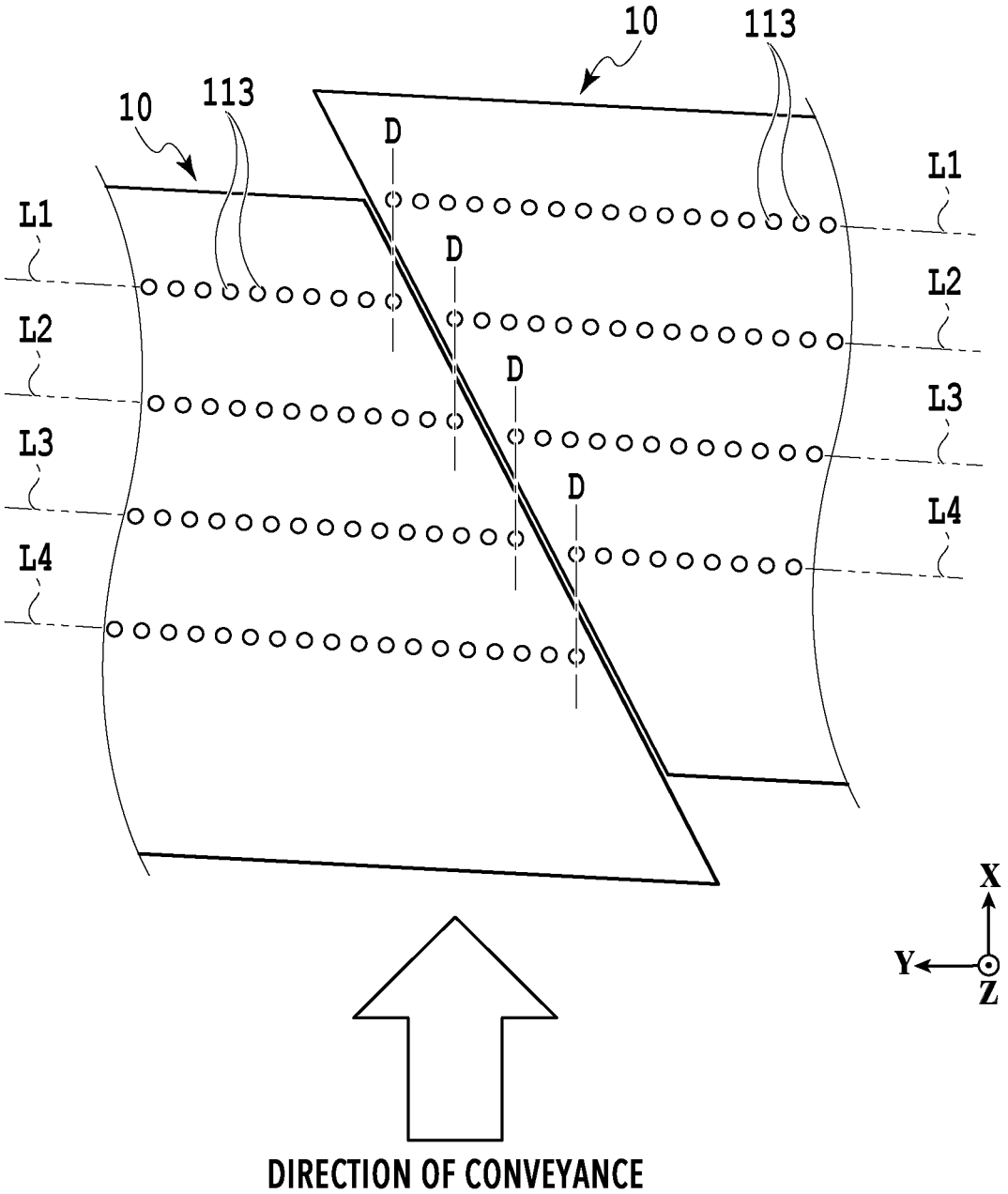
FIG. 15 is a plan view showing adjoining portions of two printing element boards.

FIG. 15 is a plan view showing partially enlarged adjoining portions of the printing element boards of two ejection modules adjacent to each other. As shown in FIG. 13A, this embodiment adopts the printing element boards each having a substantially parallelogramic shape. As shown in FIG. 15, the respective rows of the ejection ports (L1, L2, L3, and L4) formed by arraying the ejection ports 113 in each printing element board 10 are arranged in such a way as to be tilted at a predetermined angle to a direction of conveyance of a printing medium. Accordingly, the rows of the ejection ports at the adjoining portions of the printing element boards 10 are arranged such that at least one ejection port overlaps another ejection port in the direction of conveyance of the printing medium. In FIG. 15, two ejection ports on each D line overlap each other. By applying this layout, even if the position of any of the printing element boards 10 is slightly displaced from the predetermined position, it is possible to make black stripes or white spots in a printed image less conspicuous by drive control of the overlapping ejection ports. The same applies to the case where the multiple printing element boards 10 are arranged in line instead of a staggered arrangement. That is to say, the configuration shown in FIG. 15 can take measures against black stripes or white spots at joints of the printing element boards 10 while reducing an increase in length of the liquid ejection head 300 in the direction of conveyance of the printing medium. In this embodiment, the principal flat surface of each printing element board has the parallelogramic shape. However, the present invention is not limited only to this configuration. The configuration of the present invention is suitably applicable to the case of adopting the printing element boards having other shapes such as a rectangle and a trapezoid.

(First Pressure Control Mechanism and Second Pressure Control Mechanism)

Figure 16A:
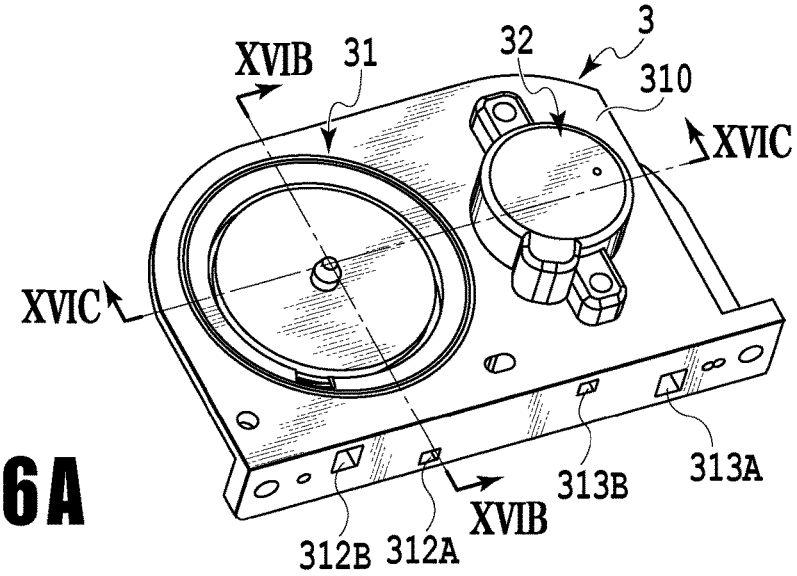
FIG. 16A is a perspective view of a negative pressure control unit in the first embodiment of the present invention.
Figure 16B:
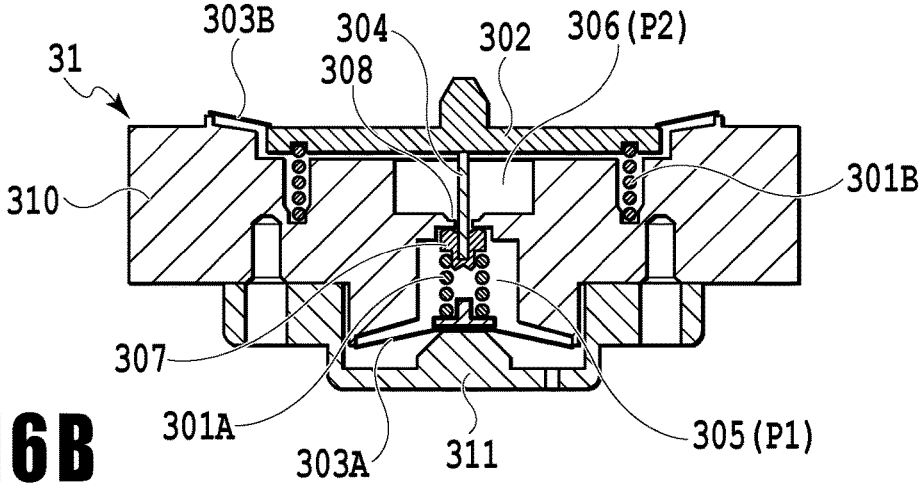
FIG. 16B is a cross-sectional view taken along the XVIB-XVIB line in FIG. 16A.
Figure 16C:
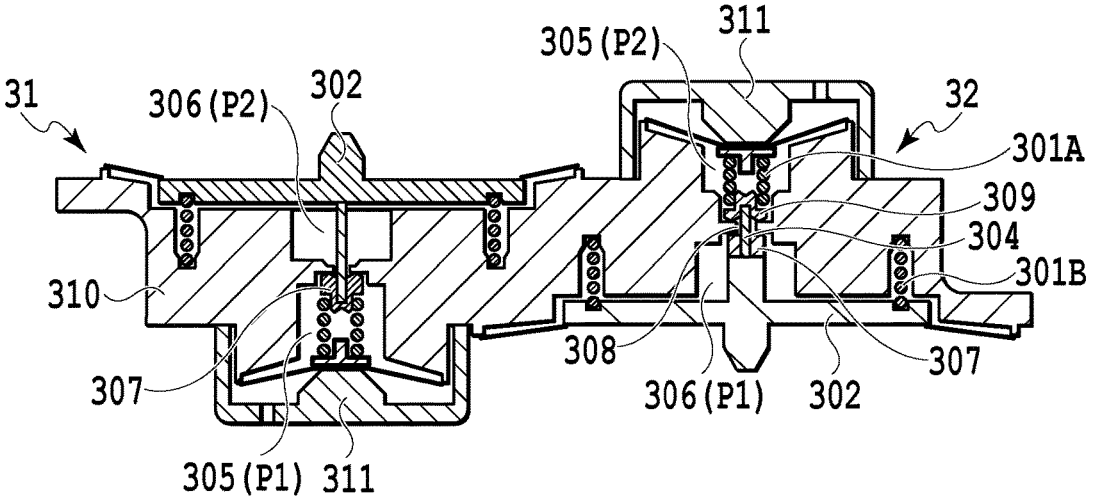
FIG. 16C is a cross-sectional view taken along the XVIC-XVIC line in FIG. 16A.

FIGS. 16A to 16C are explanatory diagrams of the negative pressure control unit 3 that includes the first pressure control mechanism 31 and the second pressure control mechanism 32. FIG. 16A is a perspective view of the negative pressure control unit 3, FIG. 16B is a cross-sectional view taken along the XVIB-XVIB line in FIG. 16A, and FIG. 16C is a cross-sectional view taken along the XVIC-XVIC line in FIG. 16A.

The first pressure control mechanism 31 as a decompression regulator mechanism and the second pressure control mechanism 32 as a back-pressure regulator mechanism are embedded in a common body 310 and are made integrally attachable or replaceable. It is possible to save space for the negative pressure control unit 3 by point-symmetrically arranging the two pressure control mechanisms 31 and 32 as shown in FIG. 16C.

(First Pressure Control Mechanism)

As shown in FIG. 16B, the first pressure control mechanism 31 as the decompression regulator mechanism includes a first pressure chamber 305 located on one side (a lower side in FIG. 16B) of the body 310, and a second pressure chamber 306 located on the other side (an upper side in FIG. 16B) of the body 310. The first pressure chamber 305 is sealed with a flexible film 303A, and the second pressure chamber 306 is sealed with a pressure plate (a pressure receiving portion) 302 and a flexible film 303B. An orifice (an orifice portion) 308 is formed between the first pressure chamber 305 and the second pressure chamber 306. A valve 307 being mechanically connected to the pressure plate 302 with a shaft 304 is located in the first pressure chamber 305, and the shaft 304, the valve 307, and the pressure plate 302 move in an integrated fashion when the liquid ejection head 300 is driven. A load is applied from a biasing member (a spring) 301B to the pressure plate 302 in such a direction that the valve 307 closes the orifice 308. In the meantime, a load is applied from a biasing member (a spring) 301A provided in the first pressure chamber 305 in the direction that the valve 307 closes the orifice 308 and in such a direction that the flexible film 303A is pressed against a negative pressure adjusting member 311.

A main function of the valve 307 is to adjust and make a flow resistance of an air flow variable by changing a gap with the orifice 308. The valve 307 is preferably configured to close the gap with the orifice 308 when circulation of the ink is suspended. By fluidically sealing the gap (a boundary) between the valve 307 and the orifice 308 when the circulation of the ink is suspended (when the printing operation is suspended), it is possible to keep the negative pressure applied to the ink at the ejection port 113 and thus to prevent the ink from leaking out of the ejection port 113. A sufficiently corrosion-resistant elastic material such as rubber or an elastomer is suitable for the material of the valve 307.

In this example, the springs serving as the biasing members 301A and 301B are formed from two connected strings. However, the springs only need to be capable of bringing about a desired negative pressure by a combined spring force thereof. Accordingly, it is also possible to adopt a configuration using only one spring or to adopt a configuration using three or more springs, for example. In the example of FIG. 16B, the biasing member 301B out of the biasing members 301A and 301B (the two connected springs) is separately provided in the second pressure chamber 306. Thus, the pressure plate 302 and the shaft 304 are configured to be separable from each other. The biasing force of the biasing member 301B in the second pressure chamber acts on the pressure plate 302 even in the state where the pressure plate 302 and the shaft 304 are separated from each other. Accordingly, even in the state where the valve 307 closes the orifice 308, it is possible to separate the pressure plate 302 from the shaft 304 with the biasing force from the biasing member 301B in the second pressure chamber 306 so as to further increase the volume inside the second pressure chamber 306. As a consequence, in the state where the liquid ejection head 300 is not driven for a long period and bubbles are taken into the liquid ejection head 300, the second pressure chamber 306 functions as a buffer that absorbs the increase in volume corresponding to the bubbles. Thus, it is possible to inhibit the pressure of the ink in the liquid ejection head 300 from turning into positive.

Each of the first pressure chamber 305 and the second pressure chamber 306 communicates with an inflow port 312A and an outflow port 312B (see FIG. 16B). The valve 307 is located on an upstream side of the orifice 308 in the ink flow direction, and the gap between the valve 307 and the orifice 308 is reduced as the pressure plate 302 moves upward in FIG. 16B. The air (the air flow) that goes into the first pressure chamber 305 from the inflow port 312A is passed through the gap between the valve 307 and the orifice 308 and flows into the second pressure chamber 306, whereby the pressure of the air is transmitted to the pressure plate 302. The air in the second pressure chamber 306 is supplied from the outflow port 312B to the liquid supply unit 220.

A pressure P2 inside the second pressure chamber 306 is determined by the following relational expression (1) that represents the equilibrium of forces applied to the respective components:

$$P2=P0-(P1\cdot Sv+k1\cdot x)/Sd \quad (1).$$

Here, Sd denotes a pressure receiving area of the pressure plate 302, Sv denotes a pressure receiving area of the valve 307, P0 denotes the atmospheric pressure, P1 denotes the pressure inside the first pressure chamber 305, and P2 denotes the pressure inside the second pressure chamber 306. Meanwhile, k1 denotes a spring constant of the biasing members 301 (301A and 301B), and x denotes a displacement (a spring displacement) of the biasing members 301 (301A and 301B).

Since the second term on the right-hand side of the above-mentioned expression (1) always takes a positive value, $P2<P0$ holds true and P2 represents the negative pressure. By changing the biasing force of the biasing members 301 (301A and 301B), the pressure P2 inside the second pressure chamber 306 can be set to a desired control pressure. The biasing forces of the biasing members 301 can be changed depending on a spring constant K and the length of the springs at the time of the operation.

A relation of the following expression (2) is satisfied between a flow resistance R at the gap between the valve 307 and the orifice 308 and a flow volume Q of passage inside the negative pressure control unit 3 (the orifice 308 to be more precise):

$$P2=P1-QR \quad (2).$$

For example, the gap (hereinafter also referred to as a "valve aperture") between the valve 307 and the orifice 308, and the flow resistance R are set to a relation shown in FIG. 17, namely, a relation in which the flow resistance R is reduced with the increase in valve aperture. The value P2 is determined by adjusting the valve aperture to satisfy the expression (1) and the expression (2) at the same time.

When the flow volume Q is increased, the flow resistance on an upstream side of the first pressure control mechanism 31 is also increased along with the increase in flow volume Q. Accordingly, the pressure P1 inside the first pressure chamber 305 is decreased in conformity to the increase in flow resistance. As a consequence, the force (P1·Sv) to close the valve 307 is decreased and the pressure P2 inside the second pressure chamber 306 is instantaneously increased as apparent from the expression (1).

Meanwhile, the expression R=(P1−P2)/Q is derived from the expression (2). The flow resistance R is reduced as the flow volume Q and the pressure P2 are increased while the pressure P1 is reduced. As the flow resistance R is reduced, the valve aperture is increased owing to the relation shown in FIG. 17. Along with the increase in valve aperture, the length of the biasing members 301 is decreased and the displacement x from the free length thereof is increased accordingly. As a consequence, an acting force (k1·x) of the biasing members 301 is increased and the pressure P2 inside the second pressure chamber 306 is instantaneously decreased as apparent from the expression (1).

On the other hand, when the flow volume Q of the air flowing into the first pressure control mechanism 31 is decreased, the first pressure control mechanism 31 performs an operation that is opposite to the case where the flow volume Q is increased. Specifically, as the pressure P1 inside the first pressure chamber 305 is increased, the pressure P2 inside the second pressure chamber 306 is instantaneously decreased. The flow resistance R is decreased by the decrease in pressure P2. As a consequence, the pressure P2 inside the second pressure chamber 306 is instantaneously increased.

Meanwhile, the expression R=(P1−P2)/Q is derived from the expression (2). Here, the flow resistance R is reduced as the values Q and P2 are increased while the value P1 is reduced. As the value R is reduced, the valve aperture is increased owing to the relation shown in FIG. 17. As apparent from FIG. 16B, when the valve aperture is increased, the length of the biasing members (the springs) 301 is reduced. Therefore, the displacement x from the free length thereof is increased. As a consequence, the acting force (k1·x) of the springs is increased. For this reason, the value P2 is instantaneously decreased according to the expression (1).

As described above, the instantaneous increases and decreases in pressure P2 are repeated and the valve aperture is changed depending on the flow volume Q so as to satisfy both the expressions (1) and (2). As a consequence, the pressure P2 inside the second pressure chamber 306 is controlled at a constant level. Accordingly, the pressure in a downstream side flow passage portion of the first pressure control mechanism 31 (on an inlet side of the liquid ejection head) is autonomously controlled at a constant level.

The negative pressure adjusting member 311 fixed to the body 310 is configured to change a storage length and the biasing force of the biasing member 301A inside the first pressure chamber 305. A projection is provided at a position on the negative pressure adjusting member 311 opposed to the first pressure chamber 305. By selectively fixing the negative pressure adjusting member 311 with the projection having a different height to the body 310, it is possible to change the biasing force of the biasing member 301A and thus to change or adjust the control pressure of the first pressure control mechanism 31. Accordingly, even when a water head difference of the negative pressure control unit 3 is different from that of a forming face at the ejection port of the liquid ejection head 300, the same first pressure control mechanism 31 can cope with this situation by changing the negative pressure adjusting member 311 with another one provided with the projection having the different height.

(Second Pressure Control Mechanism)

The second pressure control mechanism 32 as the back-pressure regulator mechanism is configured similarly to the above-described first pressure control mechanism 31 except for the different features to be described below. In this context, the same constituents as those in the first pressure control mechanism 31 will be denoted by the same reference numerals and explanations thereof will be omitted.

One of the different features is that the valve 307 of the second pressure control mechanism 32 is set up inside the second pressure chamber 306. Another one of the different features is that the gap (the valve aperture) between the valve 307 and the orifice 308 is expanded when the pressure plate 302 of the second pressure control mechanism 32 moves in the biasing direction (a downward direction in FIG. 16B) of the biasing member 301B. Still another one of the different features is that the second pressure chamber 306 of the second pressure control mechanism 32 communicates with an inflow port 313A (see FIG. 16A) while the first pressure chamber 305 of the second pressure control mechanism 32 communicates with an outflow port 313B (see FIG. 16A). Accordingly, in the second pressure control mechanism 32, the air flows in the opposite direction to that of the first pressure control mechanism 31, namely, from the second pressure chamber 306 toward the first pressure chamber 305. Still another one of the different features is that the valve 307 of the second pressure control mechanism 32 is integrated with the pressure plate 302 through the shaft 304. Moreover, the shaft 304 of the second pressure control mechanism 32 penetrates the orifice 308 and comes into contact with a shaft holder 309. The valve 307 and the pressure plate 302 are integrated together through the shaft 304, and therefore receive not only the biasing force of the biasing member 301A inside the first pressure chamber 305 but also the biasing force of the biasing member 301B inside the second pressure chamber 306.

The mechanism of pressure adjustment of the second pressure control mechanism 32 is similar to that of the first pressure control mechanism 31 described above. The pressure P1 inside the second pressure chamber 306 on the upstream side is determined by the following relational expression (3) that represents the equilibrium of forces applied to the respective components:

$$P1=P0-(P2\cdot Sv+k1\cdot x)/Sd \quad (3).$$

Here, Sd denotes the pressure receiving area of the pressure plate 302, Sv denotes the pressure receiving area of the valve 307, P0 denotes the atmospheric pressure, P1 denotes the pressure inside the second pressure chamber 306 on the upstream side, and P2 denotes the pressure inside the first pressure chamber 305 on the downstream side. Meanwhile, k1 denotes the spring constant of the biasing members 301 (301A and 301B), and x denotes the displacement (the spring displacement) of the biasing members 301 (301A and 301B). Since the second term on the right-hand side of the expression (3) always takes a positive value, P1<P0 holds true and P1 represents the negative pressure.

Meanwhile, a relation of the following expression (4) is satisfied between the flow resistance R at the gap between the valve 307 and the orifice 308 and the flow volume Q of passage through the orifice 308:

$$P1=P2-QR \quad (4).$$

Figure 17:
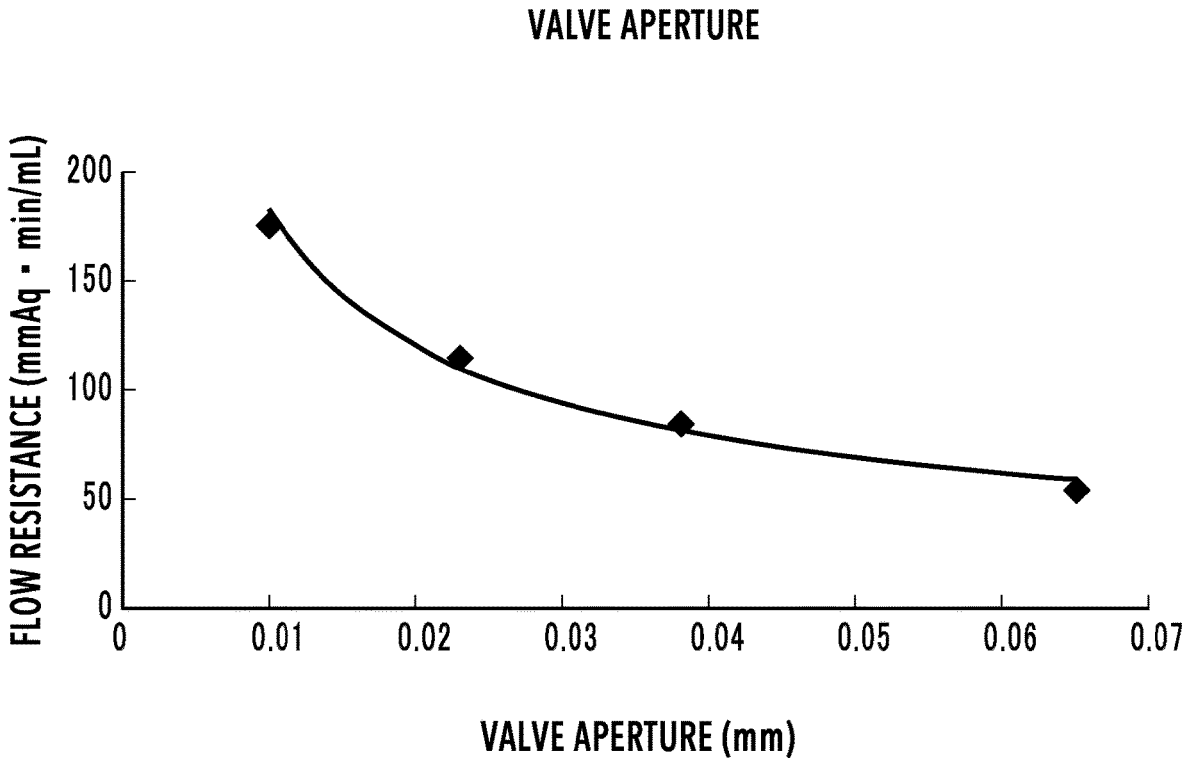
FIG. 17 is a relationship diagram between flow resistance and a valve aperture at a valve portion of a pressure control unit of the first embodiment of the present invention.

The gap (the valve aperture) between the valve 307 and the orifice 308, and the flow resistance R are set to the relation shown in FIG. 17, namely, the relation in which the flow resistance R is reduced with the increase in valve aperture. The pressure P1 inside the second pressure chamber 306 on the upstream side is determined by adjusting the valve aperture to satisfy the expression (3) and the expression (4) at the same time.

When the flow volume Q is increased, the flow resistance from the second pressure control mechanism 32 to the suction pump 1000 (see FIG. 2) is increased along with the increase in flow volume Q because the pressure of the suction pump 1000 to be connected to the downstream side of the negative pressure control unit 3 is constant. Accordingly, the pressure P2 inside the first pressure chamber 305 is increased in conformity to the increase in flow resistance. As a consequence, the force (P2·Sv) to close the valve 307 is increased and the pressure P1 inside the second pressure chamber 306 on the upstream side is instantaneously decreased as apparent from the expression (3).

Meanwhile, the expression R=(P1−P2)/Q is derived from the expression (4). The flow resistance R is reduced as the flow volume Q and the pressure P2 are increased while the pressure P1 is reduced. As the flow resistance R is reduced, the valve aperture is increased owing to the relation shown in FIG. 17. Along with the increase in valve aperture, the length of the biasing members 301 is increased and the displacement x from the free length thereof is decreased accordingly. As a consequence, the acting force (k1·x) of the biasing members 301 is decreased and the pressure P1 inside the second pressure chamber 306 on the upstream side is instantaneously increased as apparent from the expression (3).

On the other hand, when the flow volume Q of the air is decreased, the second pressure control mechanism 32 performs an operation that is opposite to the case where the flow volume Q is increased. Specifically, as the pressure P2 inside the first pressure chamber 305 on the downstream side is decreased, the pressure P1 inside the second pressure chamber 306 on the upstream side is instantaneously increased. The flow resistance R is increased by the increase in pressure P1. As a consequence, the pressure P1 inside the second pressure chamber 306 on the downstream side is instantaneously decreased.

As described above, the instantaneous increases and decreases in pressure P1 inside the second pressure chamber 306 on the upstream side are repeated and the valve aperture is changed depending on the flow volume Q so as to satisfy the expressions (3) and (4). As a consequence, the pressure P1 inside the second pressure chamber 306 on the upstream side is controlled at a constant level. Accordingly, the pressure in an upstream side flow passage portion of the second pressure control mechanism 32 (on an outlet side of the liquid ejection head) is autonomously controlled at a constant level.

As with the negative pressure adjusting member 311 in the first pressure control mechanism 31, the storage length and the biasing force of the biasing member 301A inside the second pressure chamber 306 can be changed by using the negative pressure adjusting member 311 in the second pressure control mechanism 32. Accordingly, it is possible to apply the same negative pressure control unit 3 to various printing apparatuses with different conditions of use, and thus to achieve cost reduction.

In this embodiment, the flow direction of the ink flowing on the ink flow passage that establishes the communication between the first tank and the second tank through the pressure chambers can be switched between a first direction (a forward direction) and a second direction (a reverse direction) being an opposite direction to the first direction. Thus, it is possible to discharge bubbles, thickened inks, foreign matters, and the like in each flow passage and in the vicinity of each ejection port can be discharged to the downstream side of the ejection port in the flow direction.

According to the configuration of this embodiment, the refill with the ink at the time of ejection can be stabilized even when the flow direction of the ink flowing in the ink flow passages establishing the communication between the first tank and the second tank through the pressure chambers is the first direction (the forward direction) or the second direction (the reverse direction).

Second Embodiment

A configuration according to a second embodiment of the present invention will be described. Note that the following description will explain features that are different from those in the first embodiment, and explanations of the portions similar to those in the first embodiment will be omitted.

Figure 18:
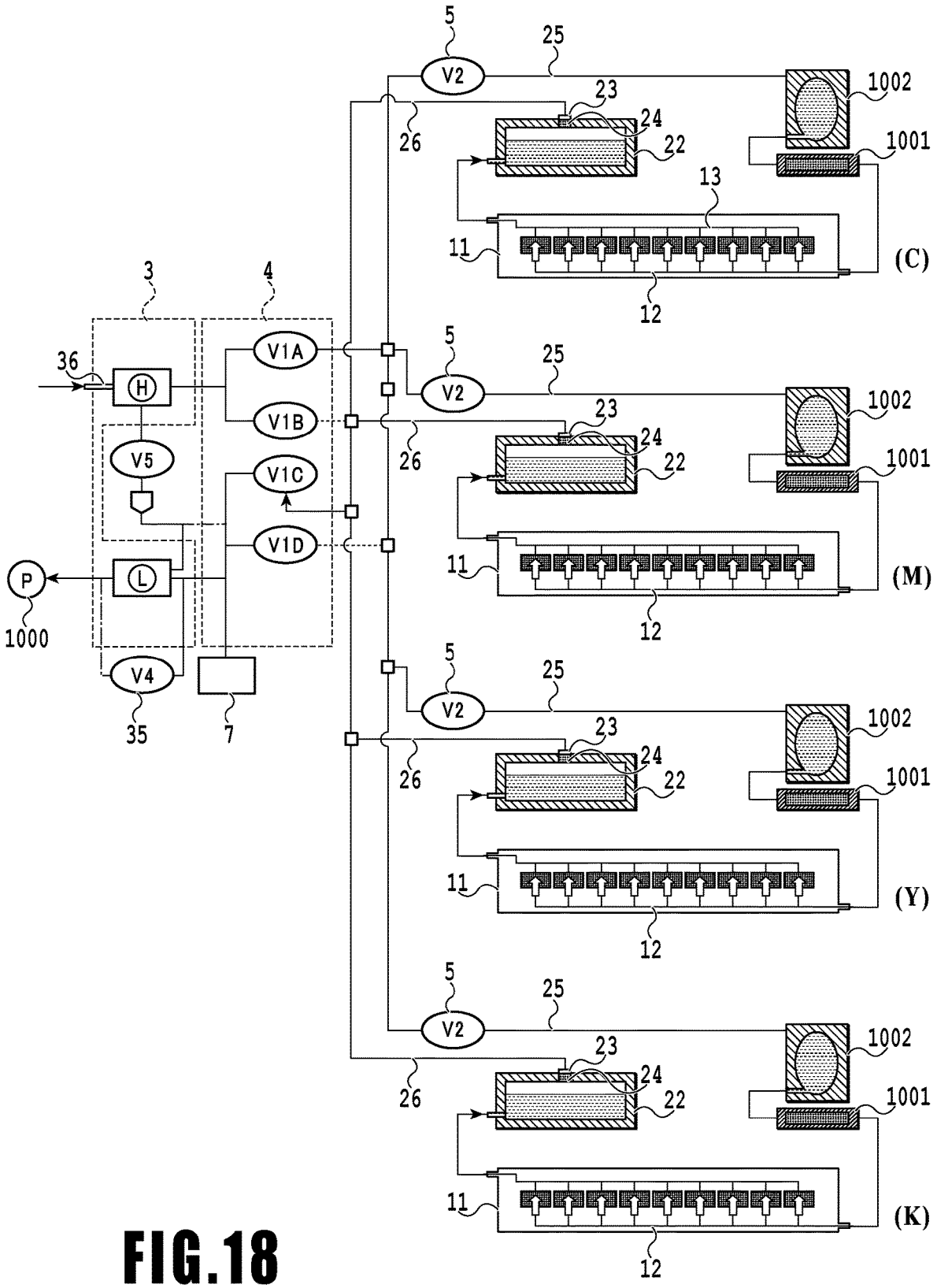
FIG. 18 is a schematic diagram showing ink channels in a printing apparatus according to a second embodiment of the present invention.

FIG. 18 is a schematic diagram showing fluid flow passages (ink flow passages and air flow passages) of a printing apparatus according to the second embodiment of the present invention. The second embodiment is different from the first embodiment in that the replaceable main tank 1002 is connected to the liquid ejection head instead of connecting the first tank thereto, and that an atmosphere communication port of the main tank 1002 is connected to the switching mechanism 4 through the individual supply valve (V2). The rest are the same as those of the first embodiment.

Preferably, the main tank 1002 of this embodiment is configured to incorporate: an inner bag provided with a residual amount detection mechanism (not shown) to detect information concerning an ink residual amount, and configured to store the ink; and the atmosphere communication port open to a tank housing. Although the configuration of the main tank as described above is common per se, this main tank can be used in such a manner as to allow the ink to go in and out unlike an ordinary main tank as a consequence of connecting the negative pressure control unit to the atmosphere communication port of the main tank 1002 through the switching mechanism. Moreover, since the ink inner bag is provided, the main tank can avoid a risk of causing color mixture of the inks in the air piping due to a rollover or the like while maintaining the internal pressure control by way of the air pressure. Furthermore, by mounting the residual amount detection mechanism to detect a deflating displacement of the inner bag, for example, the main tank can also detect the residual amount at high accuracy without being affected by an installation angle of the printing apparatus.

Among the conventional main tanks, there is one adopting a mode configured to form negative pressure generating means by providing biasing means inside an inner bag in order to prevent an ink leakage. When this mode is applied to this embodiment, it is preferable in terms of handling and the like to set the negative pressure, which is generated by the internal mechanism of the main tank, lower than the control pressure of the first pressure control mechanism, or to disable a negative pressure generation mechanism in a tank when setting up the tank.

Although it is not illustrated, the second tank 22 can also adopt a configuration to use the tank with a similar bag structure. Nevertheless, the second tank is not subject to replacement unlike the main tank side in this case. Accordingly, there is a risk of gradual deterioration in residual amount detection accuracy as part of the bubbles discharged from the inside of the liquid ejection head 300 are accumulated in the inner bag of the second tank.

In this embodiment, the ink flow direction in the liquid ejection head 300 can be inverted by the switching mechanism 4 as with the first embodiment. Moreover, the negative pressure compensation mechanism 37 is provided as with the first embodiment. For this reason, even when a large amount of the ink is ejected in a short time from any of the ejection ports 113 of the printing element board 10, it is possible to conduct the stable printing operation while suppressing excessive reduction in negative pressure in the flow passage on the downstream side of the pressure chamber in the ink low direction. In other words, according to this embodiment, it is possible to stabilize the refill with the ink at the time of ejection even when the flow direction of the ink flowing in the ink flow passages establishing the communication between the first tank and the second tank through the pressure chambers is the first direction (the forward direction) or the second direction (the reverse direction). As a consequence, it is possible to conduct the printing operation with high reliability.

In the second embodiment, it is possible to do away with using and mounting the first tank 21 and the supply valve 6 (V3) on the apparatus, and thus to achieve further cost reduction and size reduction of the ink supply system. Meanwhile, there have previously been many main tanks each designed to mount a residual amount detection mechanism. Accordingly, it is possible to curtail the residual amount detection mechanism by applying the function of such a main tank to the operation of the switching mechanism. Moreover, an operation to refill the first tank with the ink from the main tank is not required in this embodiment. Accordingly, it is possible to reduce a waiting time for printing and thus to improve printing productivity of the printing apparatus.

Third Embodiment

A configuration according to a third embodiment of the present invention will be described. The following description will explain features that are different from those in the first embodiment, and explanations of the portions similar to those in the first embodiment will be omitted.

Figure 19B:
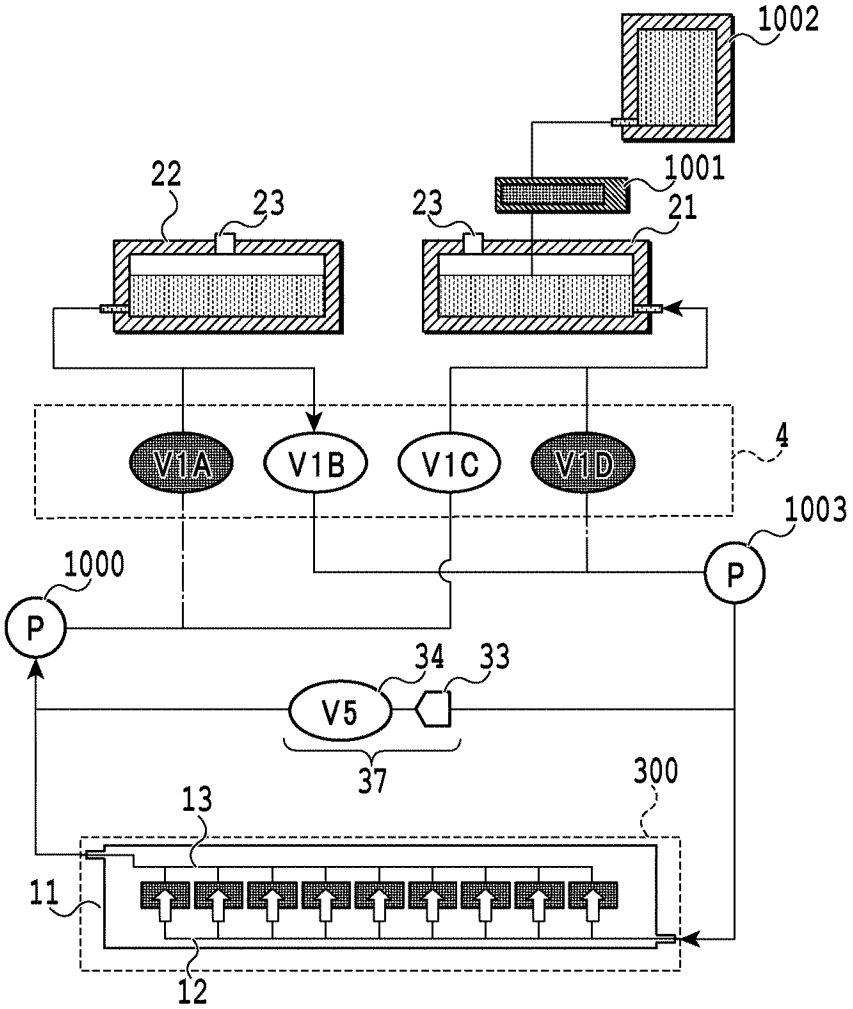
FIGS. 19A and 19B are schematic diagrams showing ink channels in a printing apparatus according to a third embodiment of the present invention.
Figure 19A:
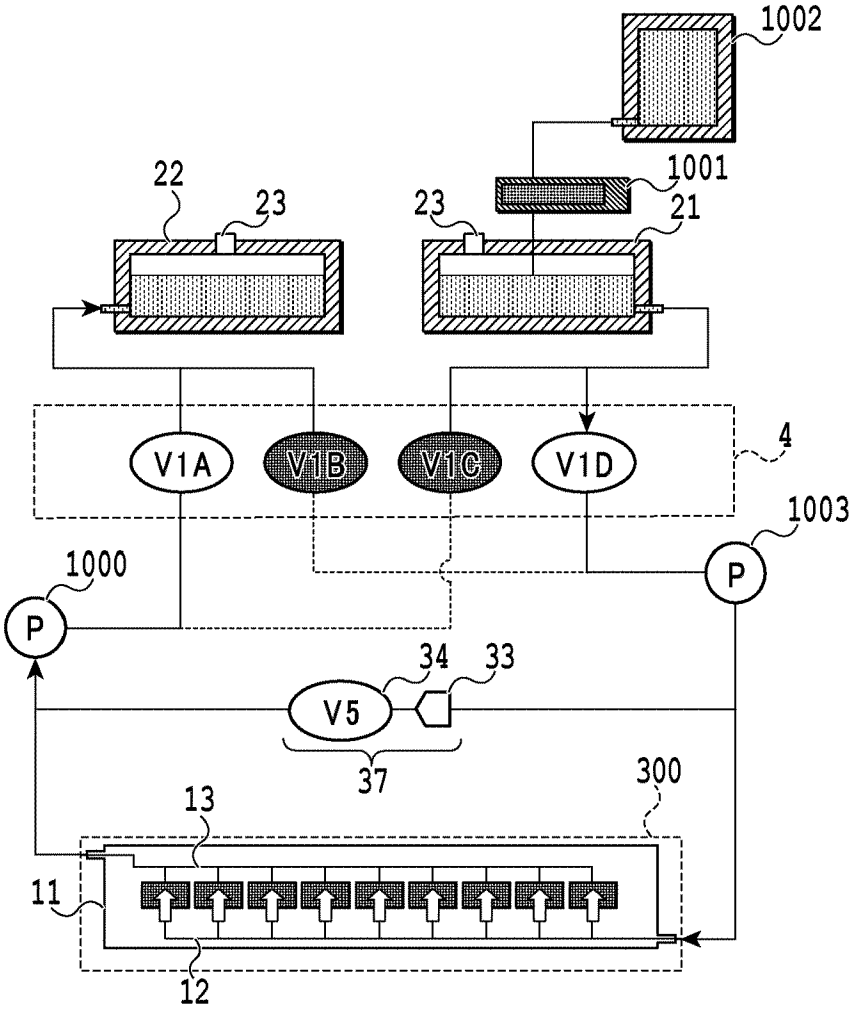

FIG. 19A is a schematic diagram showing air flow passages and ink flow passages for one of colors out of ink flow passages for four colors in total of a printing apparatus according to the third embodiment of the present invention. Third embodiment is different from the first embodiment in that the ink flow that flows inside the liquid ejection head 300 is generated by the suction pump 1000 and a booster pump 1003. Specifically, in the third embodiment, the booster pump 1003 serves the function corresponding to the first pressure control mechanism and the suction pump 1000 serves the function corresponding to the second pressure control mechanism. According to the configuration of the third embodiment, it is possible to change the ink flow volume flowing in the liquid ejection head 300 for each of the ink colors by controlling the numbers of revolutions of the pumps.

As with the first embodiment, the negative pressure compensation mechanism 37 is formed from the passive valve 33 and the on-off valve 34 (indicated as V5). However, unlike the first embodiment, the negative pressure compensation mechanism 37 is provided in the middle of a channel (a bypass flow passage) that directly connects an immediately downstream side of the booster pump 1003 to an immediately upstream side of the suction pump 1000.

The passive valve 33 is designed to be opened when a differential pressure between two sides thereof, namely, a difference between the pressure on the booster pump 1003 side and the pressure on the suction pump 1000 side is equal to or above a predetermined value. In the example of FIG. 19A, the pressure on the booster pump 1003 side corresponds to an internal pressure of an ink flow passage between the booster pump 1003 and the inlet of the liquid ejection head 300. Meanwhile, the pressure on the suction pump 1000 side corresponds to an internal pressure of an ink flow passage between the suction pump 1000 and the outlet of the liquid ejection head 300.

According to the configuration of the third embodiment, even when the pressure is reduced (the negative pressure is increased) on the downstream side (the outlet side) of the ejection port in the ink flow direction by the ejecting operation of the liquid ejection head 300, the variation in negative pressure is compensated for by opening the passive valve 33, and the excessive increase in negative pressure is thus prevented. As a consequence, it is possible to stabilize the refill with the ink at the time of ejection and to conduct the printing operation with high reliability.

The third embodiment is different from the first embodiment also in that the switching mechanism 4 is set up between the first tank as well as the second tank and the liquid ejection head 300. In FIG. 19A, the on-off valve V1A and the on-off valve V1D are open while the on-off valve V1B and the on-off valve V1C are closed. Accordingly, the ink is supplied from the first tank 21 to the booster pump 1003 through the on-off valve V1D, and then flows into the liquid ejection head 300. Thereafter, the ink is sucked into the suction pump 1000 and is transferred to the second tank 22 through the on-off valve V1A. When the amount of the ink in the second tank 22 exceeds a prescribed water level, the on-off valve V1A and the on-off valve V1D are closed while the on-off valve V1B and the on-off valve V1C are opened by a switching operation as shown in FIG. 19B. This switching operation inverts the ink flow direction viewed from the first tank and the second tank.

In the meantime, the ink flow direction in the liquid ejection head 300 is made switchable in both the forward and reverse directions in the first and second embodiments, whereas the ink flow direction in the liquid ejection head 300 is fixed to one direction in the third embodiment. In light of the layout design of the ink flow passages for the respective colors in the liquid ejection head, there may be a case where resistance on the upstream side of an ejection port is significantly different from resistance on the downstream side thereof. When the ink flow direction in the liquid ejection head 300 is inverted in this case, the negative pressure value at the ejection port significantly fluctuates depending on the ink flow direction. Hence, a difference in density on a printed material may be caused by the ink flow directions. On the other hand, this risk can be reduced by fixing the ink flow direction in the liquid ejection head 300 in one direction as in this embodiment.

In the third embodiment, the pressure control is performed as with the first and second embodiments, namely, by refilling the liquid ejection head with the liquid as appropriate depending on the pressure condition in the liquid ejection head. Thus, it is possible to improve a refilling performance of the liquid ejection head with the liquid and to stabilize a state of ejection of the liquid ejection head.

Fourth Embodiment

Figure 20:
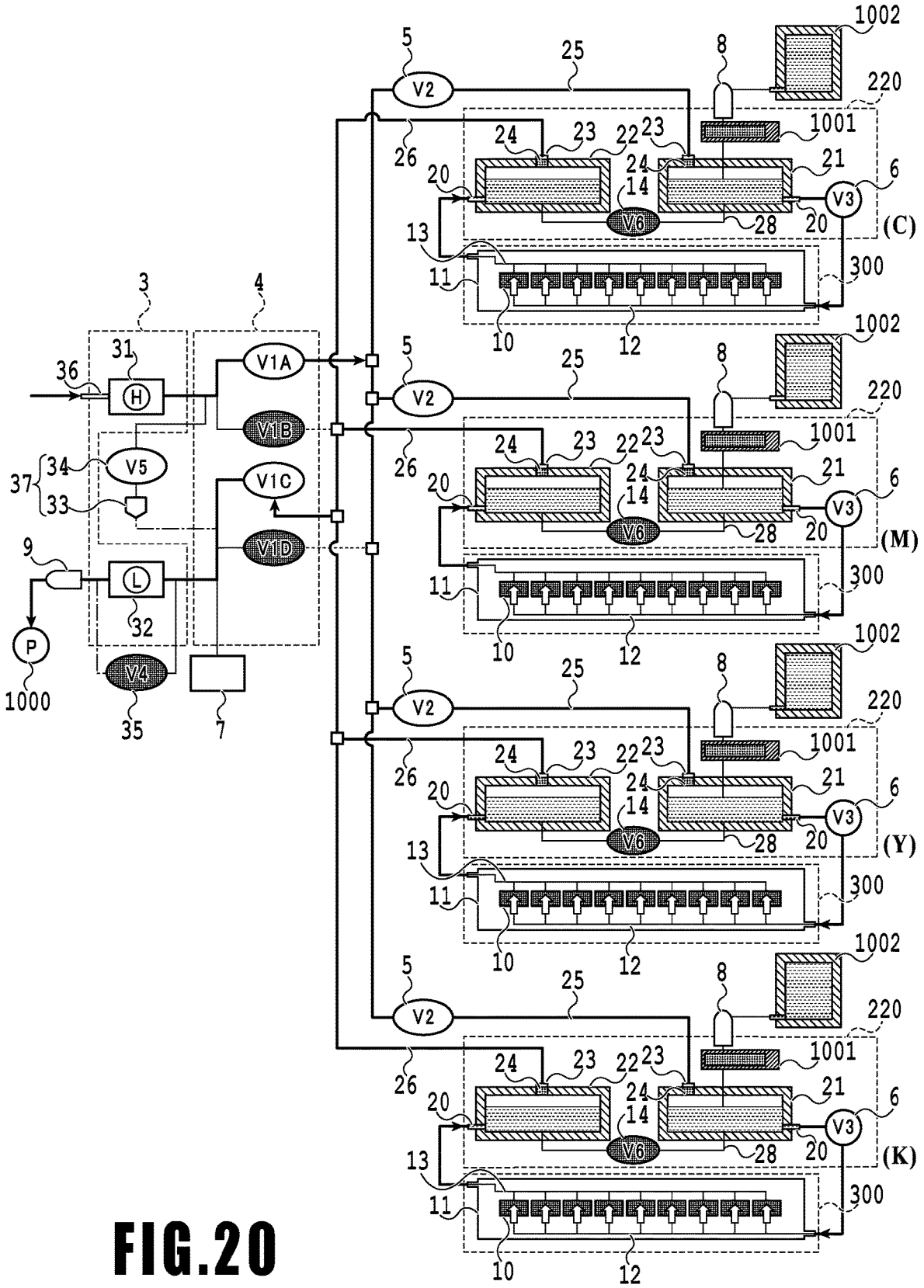
FIG. 20 is a schematic diagram showing ink channels in a printing apparatus according to a fourth embodiment of the present invention when the printing apparatus is performing printing.
Figure 21:
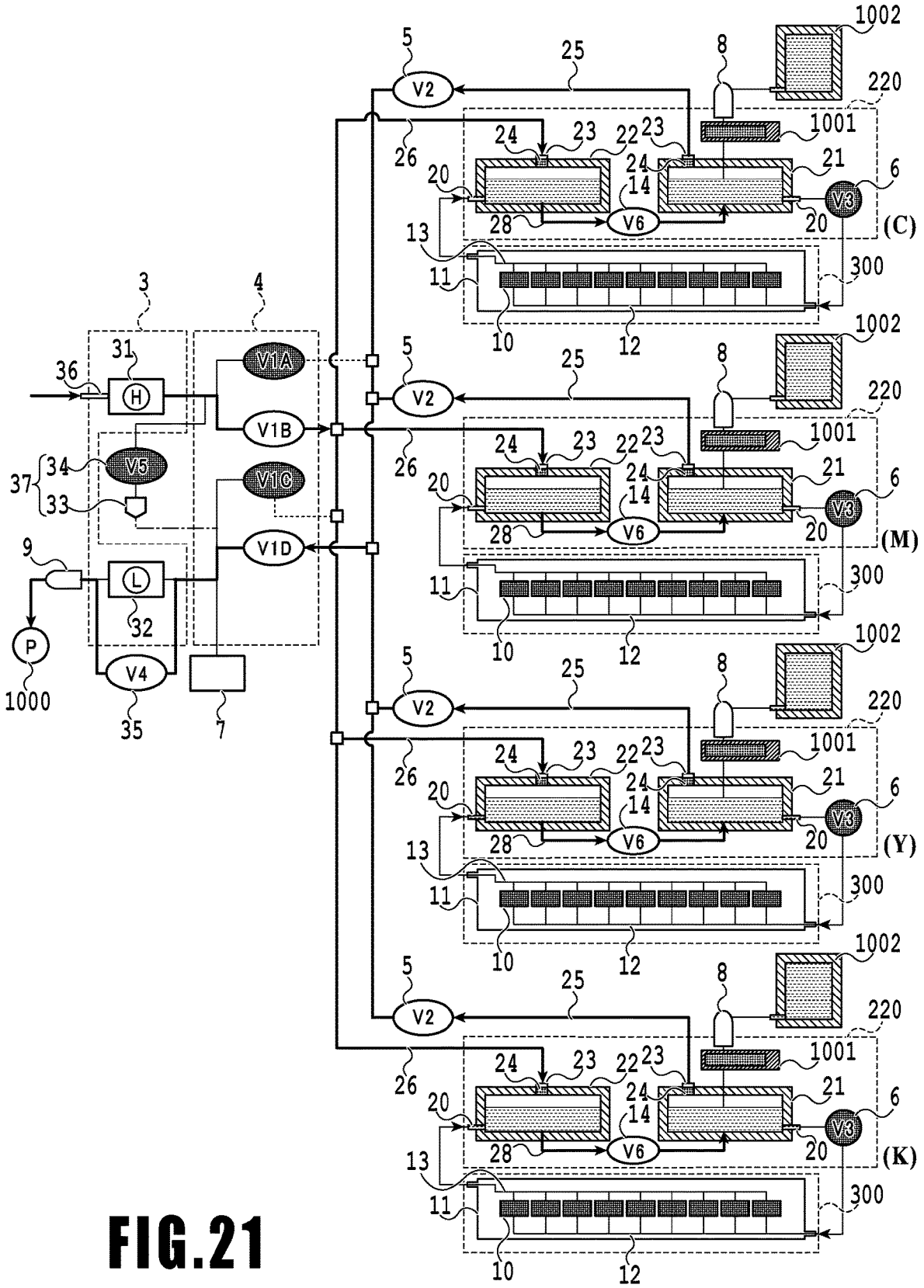
FIG. 21 is a schematic diagram showing the ink channels in the printing apparatus according to the fourth embodiment of the present invention when the printing apparatus is not performing the printing.

A configuration according to a fourth embodiment of the present invention will be described. Note that the following description will explain features that are different from those in the first embodiment, and explanations of the portions similar to those in the first embodiment will be omitted. FIGS. 20 and 21 are schematic diagrams showing fluid flow passages (ink flow passages and air flow passages) of a printing apparatus of the fourth embodiment of the present invention, in which FIG. 20 shows a state when the printing is performed and FIG. 21 shows a state when the printing is not performed.

The fourth embodiment is different from the first embodiment in that the fourth embodiment is provided with communication passages 28 to connect the first tanks for the respective colors to the corresponding second tanks, and on-off valves 14 (indicated as V6) capable of opening and closing the respective communication passages 28. The rest are the same as those of the first embodiment. An object of providing the communication passages 28 and the on-off valves 14 is to allow the inks to move quickly between the first tanks 21 and the second tanks 22. In FIG. 21, each second tank 22 is connected to the pressure control mechanism (high pressure side) 31 and each first tank 21 is connected to the suction pump 1000 through the valve V1D and the bypass valve 35 (V4). By driving the suction pump 1000, the air in the first tank 21 is evacuated and the ink flows from the second tank 22 into the first tank 21 through the communication passage 28. In this instance, the supply valve 6 (V3) is closed. For this reason, the ink in the liquid ejection head 300 is not transferred into the first tank 21. Meanwhile, the internal pressure of the second tank 22 is set to a value close enough to the control pressure of the pressure control mechanism (high pressure side) 31. Accordingly, the meniscus at each ejection port of the printing element board 10 is retained and the ink in the liquid ejection head 300 is not transferred to the second tank 22. In the meantime, a not-illustrated check valve is built in the main tank 1002. By using the check valve, the first tank 21 is refilled with the ink in the main tank 1002 through the ink joint 8 and the filter 1001. A pressure for opening and check valve is set lower than the internal pressure of the first tank 21 at the time of transportation of the ink as shown in FIG. 21. As a consequence, the ink does not flow in from the main tank 1002.

As with the first embodiment, the ink is fed in the fourth embodiment from the first tank 21 to the second tank 22 via the printing element board 10 of the liquid ejection head 300 when the printing is performed as shown in FIG. 20. However, in the fourth embodiment, the ink is transferred from the second tank 22 to the first tank 21 via the communication passage 28 and the valve 14 (V6) when the printing is not performed as shown in FIG. 21. Accordingly, the ink flow direction in the printing element board 10 at the time of printing can be limited to one direction, so that it is easy to estimate temperature distribution in the direction of the row of the ejection ports.

For example, let us suppose that each first individual flow passage 213 in FIG. 10 is located on the upstream side in the ink flow direction of the printing element board 10 while each second individual flow passage 214 therein is located on the downstream side in the flow direction. In this case, the temperature of the ink flowing into the printing element board 10 is usually low, and the ink in each ejection port in the vicinity of the first individual flow passage 213 tends to be low in temperature. On the other hand, the ink in the printing element board 10 receives the heat and is subjected to a rise in temperature whereby the temperature of the ink flowing out of the printing element board 10 is thus increased. Thus, the ink in each ejection port around the second individual flow passage 214 tends to be high in temperature. Accordingly, the temperature distribution including a low temperature part and a high temperature part is developed in the direction of the row of the ejection ports, and this temperature distribution is substantially in conformity with the positional relation of the first individual flow passages 213 and the second individual flow passages 214. Based on estimated values of the above-described temperature distribution, a not-illustrated control apparatus of the main body of the printing apparatus adjusts the number of hits of ejected ink droplets per unit area on the printing medium. Thus, it is possible to correct unevenness in density in a printed image, which is attributed to changes in volume of the ejected inks that occur in response to the temperature distribution.

When the ink flow direction in the printing element board 10 is inverted as in the first embodiment, the temperature distribution in the printing element board 10 is also inverted. Accordingly, if the control mode to adjust the number of hits of ejected ink droplets is fixed, it is not possible to cope with the above-described inversion of the temperature distribution, and correction of the unevenness in density in the printed image is difficult. Even in the above-described first embodiment, the switching of the control mode to adjust the number of hits of ejected ink droplets depending on the ink flow direction in the printing element board 10 enables the correction of the unevenness in density in the printed image in response to the inversion of the temperature distribution. In this case, however, it is likely to cause complication of the control on the main body side of the printing apparatus.

Meanwhile, in order to transport the inks more reliably while minimizing the amounts of bubbles in the first tanks 21 and the second tanks 22 to be taken into the communication passages 28, it is preferable to locate positions of communication of the communication passages 28 with the second tanks 22 lower than the liquid levels in the second tanks 22.

Figure 22:
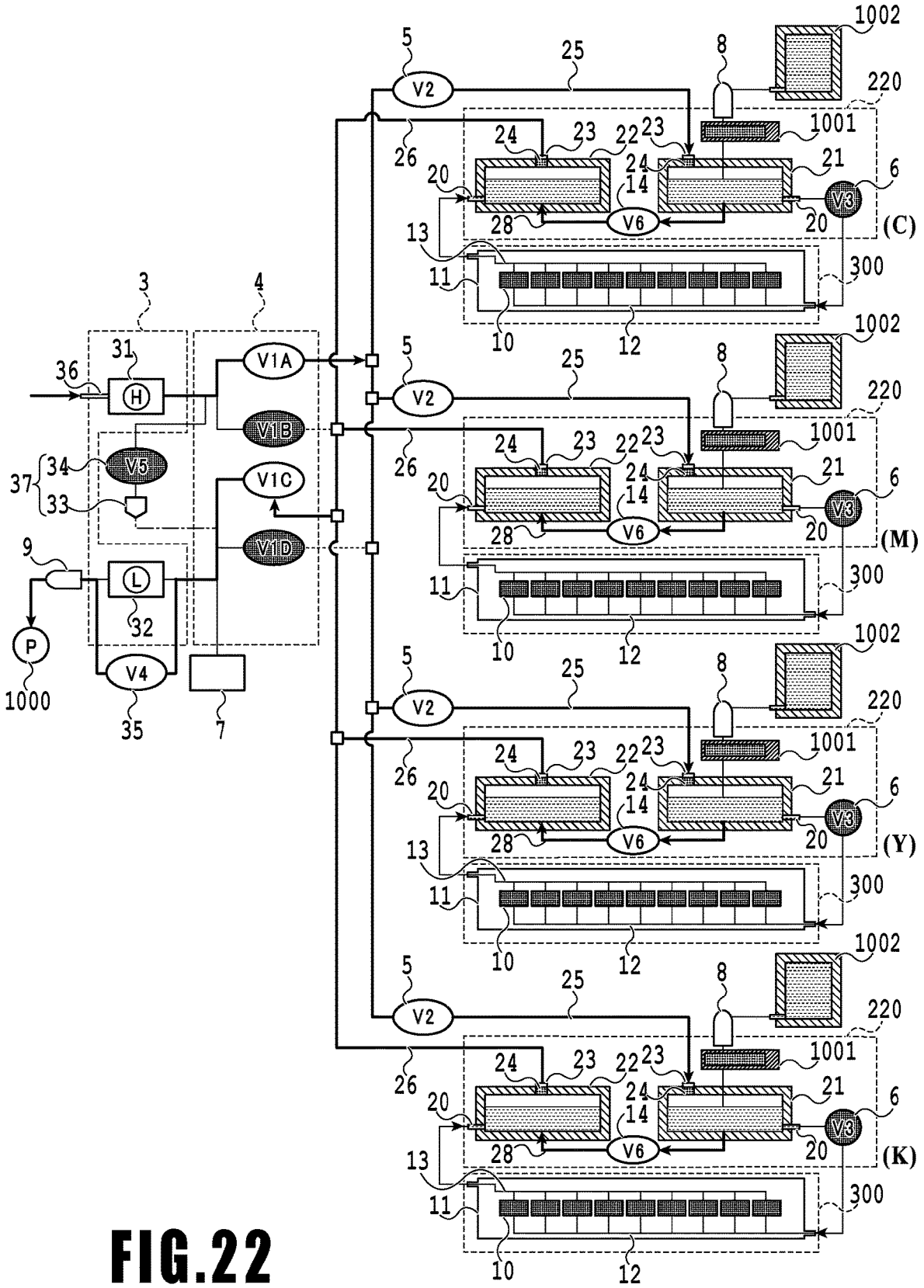
FIG. 22 is a schematic diagram showing another state of the ink channels in the printing apparatus according to the fourth embodiment of the present invention when the printing apparatus is not performing the printing.

In the meantime, transporting the ink between the first tank 21 and the second tank 22 through the communication passage 28 is preferable to suppress sedimentation of pigment components in the ink when the ink is a pigment ink that contains such pigment components. FIG. 22 is another schematic diagram showing the fluid flow passages (the ink flow passages and the air flow passages) in the case of transporting the inks from the first tanks 21 to the corresponding second tanks 22 through the communication passages 28 when the printing is not performed. FIG. 22 shows an opposite case to the case in FIG. 21, in which each first tank 21 is connected to the pressure control mechanism (high pressure side) 31 and each second tank 22 is connected to the suction pump 1000 through the valve V1C and the bypass valve 35 (V4). The rest are the same as the case in FIG. 21. Here, the ink is transported from the first tank 21 to the second tank 22 by driving the suction pump 1000.

When the printing is not performed, it is possible to agitate the inks in the passages by alternately repeating the transportation of the inks shown in FIG. 21 and the transportation of the inks shown in FIG. 22 so as to move the inks back and forth between the first tanks 21 and the second tanks 22. Thus, the sedimentation of the pigment components in the inks put in the first tanks 21 and the second tanks 22 can be suppressed without having to add a particular configuration to agitate the inks. In order to more enhance agitation efficiency of the inks by the flows of the inks through the communication passages 28, it is preferable to provide a static mixer in each of the first tanks 21 and the second tanks 22 near a junction with the corresponding communication passage 28.

Note that the first embodiment can also agitate the inks in the first and second tanks as with the fourth embodiment by inverting the ink flow directions. However, there is not a large flow amount of the ink that can be passed through the printing element board 10 within a range of the negative pressure with which it is possible to maintain the meniscus of the ink formed at each ejection port. In this regard, the fourth embodiment can eliminate the sedimentation of the pigment components in a shorter time.

Moreover, the communication passages 28 and the valves 14 (V6) of the fourth embodiment can be added not only to the configuration of the first embodiment but also to the configurations of the second and third embodiments.

Other Embodiments

While the above-described first to third embodiments adopt the Bubble Jet (registered trademark) mode as the liquid ejection mode, the present invention is also applicable to liquid ejection heads adopting a piezoelectric mode.

The mode of the printing apparatus is not limited only to a full line mode as in the above-described embodiments. The present invention is also applicable to a printing apparatus adopting a so-called serial scanning mode, which is configured to record an image by repeating movement of the liquid ejection head in a main scanning direction and movement of a printing medium in a vertical scanning direction.

The present invention is widely applicable to liquid supply apparatuses that supply various liquids and to liquid ejection apparatuses that can eject various liquids. Moreover, the present invention is applicable to inkjet apparatuses configured to perform various treatments (such as printing, processing, coating, irradiation, reading, and inspection) on various media (sheets) by using inkjet heads capable of ejecting liquids. Such media (inclusive of the printing medium) encompass various media to be subjected to attachment of liquids including the inks, and the media may be formed from any materials including paper, plastics, films, fabrics, metals, flexible boards, and so forth.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2017-191327, filed Sep. 29, 2017, and No. 2018-159187, filed Aug. 28, 2018, which are hereby incorporated by reference wherein in their entirety.

What is claimed is:

1. A liquid ejection apparatus comprising:

an ejection port configured to eject a liquid;

a pressure chamber configured to store the liquid to be ejected from the ejection port;

an element configured to generate energy for ejecting the liquid in the pressure chamber;

a first tank and a second tank each configured to be capable of storing the liquid;

a flow passage configured to establish communication between the first tank and the second tank through the pressure chamber;

a switching unit configured to switch a flowing direction of the liquid in the flow passage between a first direction to flow from the first tank to the second tank and a second direction to flow from the second tank to the first tank; and a pressure compensation unit configured, when a pressure in a downstream side flow passage portion of the flow passage located on a downstream side of the pressure chamber in the flowing direction of the liquid is a predetermined pressure or below, to compensate for reduction in pressure in the downstream side flow passage portion by supplying the liquid to the downstream side flow passage portion;

wherein the liquid ejection apparatus further comprises a pressure control unit configured to generate a difference in pressure between the downstream side flow passage portion and an upstream side flow passage portion located on an upstream side of the pressure chamber in the flowing direction of the liquid such that the difference in pressure generates a flow of the liquid in the flow passage to cause the liquid to pass through the pressure chamber, wherein the pressure control unit includes:

a first pressure controller configured to perform control such that a pressure inside the upstream side flow passage portion is set to a first pressure; and a second pressure controller configured to perform control such that a pressure inside the downstream side flow passage portion is set to a second pressure being lower than the first pressure;

wherein each of the first tank and the second tank includes an air connection port configured to allow air to go into and out of the air portion in the corresponding tank, wherein the air connection port of the first tank is connected to any one of a first pressure controller and a second pressure controller through an air channel in a switchable manner by using the switching unit, the first pressure controller configured to perform the control such that the pressure inside the upstream side flow passage portion located on the upstream side of the pressure chamber in the flowing direction of the liquid is set to the first pressure, the second pressure controller configured to perform the control such that the pressure inside the downstream side flow passage portion is set to the second pressure being lower than the first pressure, and wherein the air connection port of the second tank is connected to any one of the first pressure controller and the second pressure controller through an air channel in a switchable manner by using the switching unit.

2. The liquid ejection apparatus according to claim 1, further comprising:

a communication passage configured to establish communication between the first tank and the second tank; and a valve configured to be capable of opening and closing the communication passage.

3. The liquid ejection apparatus according to claim 1, further comprising:

a pump located at a position on a downstream side of the second pressure controller in the flowing direction.

4. The liquid ejection apparatus according to claim 1, further comprising:

a bypass channel configured to connect upstream and downstream parts of the second pressure controller in the flowing direction, wherein the bypass channel includes a bypass on-off valve configured to be capable of performing opening and closing control of the bypass channel.

5. The liquid ejection apparatus according to claim 1, wherein the pressure compensation unit includes a communication passage configured to establish communication between an air portion in the first tank and an air portion in the second tank when the pressure in the downstream side flow passage portion is the predetermined pressure or below.

6. The liquid ejection apparatus according to claim 5, wherein the pressure compensation unit includes a passive valve configured to open and close the communication passage depending on a difference between the pressure in the downstream side flow passage portion and a pressure in an upstream side flow passage portion located on an upstream side of the pressure chamber in the flowing direction of the liquid.

7. The liquid ejection apparatus according to claim 5, wherein the communication passage includes an on-off valve configured to be capable of performing opening and closing control.

8. The liquid ejection apparatus according to claim 1, wherein any one of a gas-liquid separation membrane and a water-repellent filter is provided to at least one of the air connection port and the air channel of each of the first tank and the second tank.

9. The liquid ejection apparatus according to claim 7, further comprising:

an on-off valve set up in the air channel between the switching unit and the first tank, and configured to allow at least one of the liquid and/or air to go into and out of the first tank by being opened, and to be closed when power is off, wherein the switching unit includes:

a first switching portion provided with an upstream end connected to a downstream part of a first pressure controller configured to perform control such that a pressure inside an upstream side flow passage portion located on an upstream side of the pressure chamber in the flowing direction of the liquid is set to a first pressure, and with a downstream end connected to an upstream part of any one of the first tank and the second tank in a switchable manner, and a second switching portion provided with a downstream end connected to an upstream part of a second pressure controller configured to perform control such that a pressure inside a downstream side flow passage portion located on a downstream side of the pressure chamber in the flowing direction of the liquid is set to a second pressure being lower than the first pressure, and with an upstream end connected to a downstream part of any one of the first tank and the second tank in a switchable manner, and wherein the first switching portion connects the downstream end of the first switching portion to the upstream part of the first tank and the second switching portion connects the upstream end of the second switching portion to the downstream part of the second tank when power is off.

10. The liquid ejection apparatus according to claim 1, wherein the flow passage communicates with each of a plurality of the pressure chambers.

11. The liquid ejection apparatus according to claim 7, wherein the liquid ejection apparatus is capable of ejecting a plurality of types of liquids, a plurality of sets of the first tank and the second tank are provided corresponding to the types of the liquids, each of the first tanks and the second tanks includes an air connection port configured to allow air to go into and out of the air portion in the corresponding tank, the air connection ports of the first tanks for the respective liquid types are connected to any one of a first pressure controller and a second pressure controller through an air channel by using the switching unit, the first pressure controller being configured to perform control such that a pressure inside an upstream side flow passage portion located on an upstream side of the pressure chamber in the flowing direction of the liquid is set to a first pressure, the second pressure controller provided being configured to perform control such that a pressure inside the downstream side flow passage portion located on the downstream side of the pressure chamber in the flowing direction of the liquid is set to a second pressure being lower than the first pressure, and the air connection ports of the second tanks for the respective liquid types are connected the other one of the common first pressure controller and the common second pressure controller through an air channel by using the switching unit.

12. The liquid ejection apparatus according to claim 1, further comprising:

a bypass flow passage in which the pressure compensation unit is set up, the bypass flow passage being located between a first position and a second position, the first position being located on the downstream side of the first pressure controller in the flowing direction and on the upstream side of the pressure chamber in the flowing direction, the second position being located on the upstream side of the second pressure controller in the flowing direction and on the downstream side of the pressure chamber in the flowing direction, and the pressure compensation unit opens the bypass flow passage when the pressure in the downstream side flow passage portion is the predetermined pressure or below.

13. The liquid ejection apparatus according to claim 12, wherein the pressure compensation unit includes a passive valve configured to open and close the bypass flow passage depending on the difference between the pressure in the upstream side flow passage portion and the pressure in the downstream side flow passage portion.

14. The liquid ejection apparatus according to claim 13, wherein the bypass flow passage further includes an on-off valve configured to be capable of performing opening and closing control.

15. The liquid ejection apparatus according to claim 1, further comprising:

a communication passage configured to establish communication between the first tank and the second tank without through the pressure chamber; and a valve configured to open and close the communication passage.

16. The liquid ejection apparatus according to claim 15, wherein the communication passage allows the liquid to flow from the second tank to the first tank and does not allow the liquid to flow from the first tank to the second tank.

17. The liquid ejection apparatus according to claim 15, wherein the liquid ejection apparatus performs printing by ejecting the liquid from the ejection port in a state where the liquid flows in the flow passage in the first direction, and does not perform printing in a state where the liquid flows in the flow passage in the second direction.

18. A liquid ejection head to be used by being mounted on the liquid ejection apparatus according to claim 1, comprising:

an element board including the ejection port configured to eject the liquid, the pressure chamber configured to store the liquid to be ejected from the ejection port, and the element configured to generate the energy for ejecting the liquid in the pressure chamber, the first tank and the second tank each configured to be capable of storing the liquid; and a support body configured to support the element board, and provided with the flow passage to establish the communication between the first tank and the second tank through the pressure chamber.

19. The liquid ejection head according to claim 18, wherein the element board ejects the liquid by using a pressure of a bubble generated by applying heat to the liquid.

20. The liquid ejection head according to claim 18, wherein the liquid in the pressure chamber is circulated between inside and outside of the pressure chamber.

21. The liquid ejection head according to claim 18, further comprising a pressure control unit configured to generate a difference in pressure between the downstream side flow passage portion and an upstream side flow passage portion located on an upstream side of the pressure chamber in the flowing direction of the liquid such that the difference in pressure generates a flow of the liquid in the flow passage to cause the liquid to pass through the pressure chamber, wherein the pressure control unit includes a first pressure controller configured to perform control such that a pressure inside the upstream side flow passage portion is set to a first pressure, and a second pressure controller configured to perform control such that a pressure inside the downstream side flow passage portion is set to a second pressure being lower than the first pressure, a pressure higher than the first pressure is applied to the first pressure controller from an upstream side in the flowing direction, and the first pressure controller includes:

a first pressure chamber configured to communicate with any of the first tank and the second tank;

a second pressure chamber having a variable volume and being connected to the flow passage at a position on the upstream side of the pressure chamber in the flowing direction;

an orifice portion provided at a boundary between the first pressure chamber and the second pressure chamber;

a valve provided in the first pressure chamber and configured to make flow resistance between the first pressure chamber and the second pressure chamber variable, the valve being biased by application of a load in a direction to close a gap with the orifice portion; and a pressure receiving portion being displaceable based on a variation in pressure in the second pressure chamber, and configured to transmit the displacement to the valve to make a position of the valve variable in combination with a biasing force applied to the valve.

22. The liquid ejection head according to claim 18, further comprising a pressure control unit configured to generate a difference in pressure between the downstream side flow passage portion and an upstream side flow passage portion located on an upstream side of the pressure chamber in the flowing direction of the liquid such that the difference in pressure generates a flow of the liquid in the flow passage to cause the liquid to pass through the pressure chamber, wherein the pressure control unit includes a first pressure controller configured to perform control such that a pressure inside the upstream side flow passage portion is set to a first pressure, and a second pressure controller configured to perform control such that a pressure inside the downstream side flow passage portion is set to a second pressure being lower than the first pressure, a pressure lower than the second pressure is applied to the second pressure controller from an upstream side in the flowing direction, and the second pressure controller includes:

a first pressure chamber having a variable volume and being connected to the flow passage at a position on the downstream side of the pressure chamber in the flowing direction;

a second pressure chamber configured to communicate with the flow passage at a position on a downstream side of the second pressure controller in the flowing direction;

an orifice portion provided at a boundary between the first pressure chamber and the second pressure chamber;

a valve provided in the first pressure chamber and configured to make flow resistance between the first pressure chamber and the second pressure chamber variable, the valve being biased by application of a load in a direction to close a gap with the orifice portion; and a pressure receiving portion being displaceable based on a variation in pressure in the first pressure chamber, and configured to transmit the displacement to the valve to make a position of the valve variable in combination with a biasing force applied to the valve.

23. A liquid ejection apparatus comprising:

an ejection port configured to eject a liquid;

a pressure chamber configured to store the liquid to be ejected from the ejection port;

an element configured to generate energy for ejecting the liquid in the pressure chamber;

a first tank and a second tank each configured to be capable of storing the liquid;

a flow passage configured to establish communication between the first tank and the second tank through the pressure chamber;

a switching unit configured to switch a flowing direction of the liquid in the flow passage between a first direction to flow from the first tank to the second tank and a second direction to flow from the second tank to the first tank;

a first pressure adjustment passage and a second pressure adjustment passage each configured to adjust a pressure in the first tank and the second tank;

a communication passage configured to establish communication between the first pressure adjustment passage and the second pressure adjustment passage; and a passive valve provided in the communication passage, and configured to open and close the communication passage depending on a difference between the pressure in a downstream side flow passage portion located on a downstream side of the pressure chamber in the flowing direction of the liquid and a pressure in an upstream side flow passage portion located on an upstream side of the pressure chamber in the flowing direction of the liquid, wherein the passive valve is configured such that a pressure inside the upstream side flow passage portion is set to a first pressure and such that a pressure inside the downstream side flow passage portion is set to a second pressure being lower than the first pressure, wherein each of the first tank and the second tank includes an air connection port configured to allow air to go into and out of the air portion in the corresponding tank, wherein the air connection port of the first tank is connected to the passive valve through an air channel in a switchable manner by using the switching unit, such that the pressure inside the upstream side flow passage portion located on the upstream side of the pressure chamber in the flowing direction of the liquid is set to the first pressure, and such that the pressure inside the downstream side flow passage portion is set to the second pressure being lower than the first pressure, and wherein the air connection port of the second tank is connected to the passive valve through an air channel in a switchable manner by using the switching unit.

24. The liquid ejection apparatus according to claim 23, wherein the liquid in the upstream side flow passage portion is applied to the downstream side flow passage portion through the communication passage by opening the passive valve.

* * * * *